US007325654B2

(12) United States Patent
Stanislao

(10) Patent No.: US 7,325,654 B2
(45) Date of Patent: Feb. 5, 2008

(54) LIST APPARATUSES AND METHOD

(76) Inventor: Joseph Stanislao, 8 Park Plaza Dr., Bozeman, MT (US) 59715-9343

( * ) Notice: Subject to any disclaimer, the term of this patent is extended or adjusted under 35 U.S.C. 154(b) by 74 days.

(21) Appl. No.: 11/288,545

(22) Filed: Nov. 28, 2005

(65) Prior Publication Data

US 2006/0180399 A1 Aug. 17, 2006

Related U.S. Application Data

(60) Provisional application No. 60/631,745, filed on Nov. 30, 2004.

(51) Int. Cl.
*B66B 9/08* (2006.01)
*B66F 7/28* (2006.01)

(52) U.S. Cl. ..... 187/201; 187/203; 187/216; 187/244

(58) Field of Classification Search ..... 187/201, 187/203, 216, 244
See application file for complete search history.

(56) References Cited

U.S. PATENT DOCUMENTS 4,531,614 A * 7/1985 Naegeli ..... 187/240
5,044,473 A * 9/1991 Gripe ..... 187/244
5,050,708 A * 9/1991 Wood ..... 187/201
5,105,915 A * 4/1992 Gary ..... 187/200
5,370,206 A * 12/1994 Chao ..... 187/255
5,499,694 A * 3/1996 Dorn ..... 187/200
5,901,812 A * 5/1999 Meunier ..... 187/200
6,105,726 A * 8/2000 Taylor et al. ..... 187/201
6,171,198 B1 * 1/2001 Lizama Troncoso et al. . 472/29
6,517,443 B1 * 2/2003 Villella ..... 472/95
2006/0180399 A1 * 8/2006 Stanislao ..... 187/201

* cited by examiner

*Primary Examiner*—Patrick Mackey
*Assistant Examiner*—Terrell Matthews
(74) *Attorney, Agent, or Firm*—Shane P. Coleman; Holland & Hart LLP

(57) ABSTRACT

A lift apparatus is disclosed. Particularly, a lift apparatus may comprise a support frame and a platform movably coupled to the support frame. Further, the platform may comprise at least one roller and a transmission connected to the at least one roller of the assembly, wherein rotation of the at least one roller causes the platform to move relative to the support frame. Another aspect of the present invention relates to a method of moving a wheelchair lift. Particularly, a wheelchair may be positioned such that at least one wheel of the wheelchair contacts a drive mechanism of a platform, wherein platform is positioned at an initial position. Further, the at least one wheel of the wheelchair may be rotated to cause the platform to move relative to the initial position.

16 Claims, 22 Drawing Sheets

LIST APPARATUSES AND METHOD

CROSS-REFERENCE TO RELATED APPLICATION

This application claims the benefit of U.S. Provisional Patent Application No. 60/631,745, filed Nov. 30, 2004, the disclosure of which is incorporated, in its entirety, by this reference.

FIELD OF INVENTION

The present invention relates generally to lift apparatuses and methods for facilitating mobility of wheel chair bound persons. In one application, such lift apparatuses may be operated by rotation of at least one wheel of a wheelchair.

BACKGROUND

Mobility may be challenging for physically-challenged people. Conventional ramps, wheel chairs, wheel chair lifts, and other types of ramps have enhanced, to some degree, mobility for physically-challenged people. Although such conventional devices have improved the mobility for physically-challenged persons, vertical mobility, for instance, inside and outside of buildings may remain difficult or impossible. Such difficulty may be exacerbated when other limitations exist, such as unavailability of elevators or electric power.

Accordingly, improved apparatuses and methods for providing enhanced mobility to physically-challenged people would be desirable and useful.

SUMMARY

One aspect of the present invention relates to a lift apparatus. Particularly, a lift apparatus may comprise a support frame and a platform movably coupled to the support frame, wherein the platform may comprise at least one roller. Further a transmission may be connected to the at least one roller of the assembly, wherein rotation of the at least one roller causes the platform to move relative to the support frame. In one embodiment, a support frame may include at least one columnar assembly. Generally, a support frame may include at least one column.

Another aspect of the present invention relates to a method of moving a wheelchair lift. Particularly, a wheelchair may be positioned such that at least one wheel of the wheelchair contacts a drive mechanism of a platform, wherein the platform is positioned at an initial position. Further, the at least one wheel of the wheelchair may be rotated to cause the platform to move relative to the initial position.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

BRIEF DESCRIPTION OF THE DRAWINGS

Advantages of the present invention will become apparent upon review of the following detailed description and drawings, which illustrate representations (not necessarily drawn to scale) of various aspects of the present invention, wherein.

DETAILED DESCRIPTION

Figure 1:
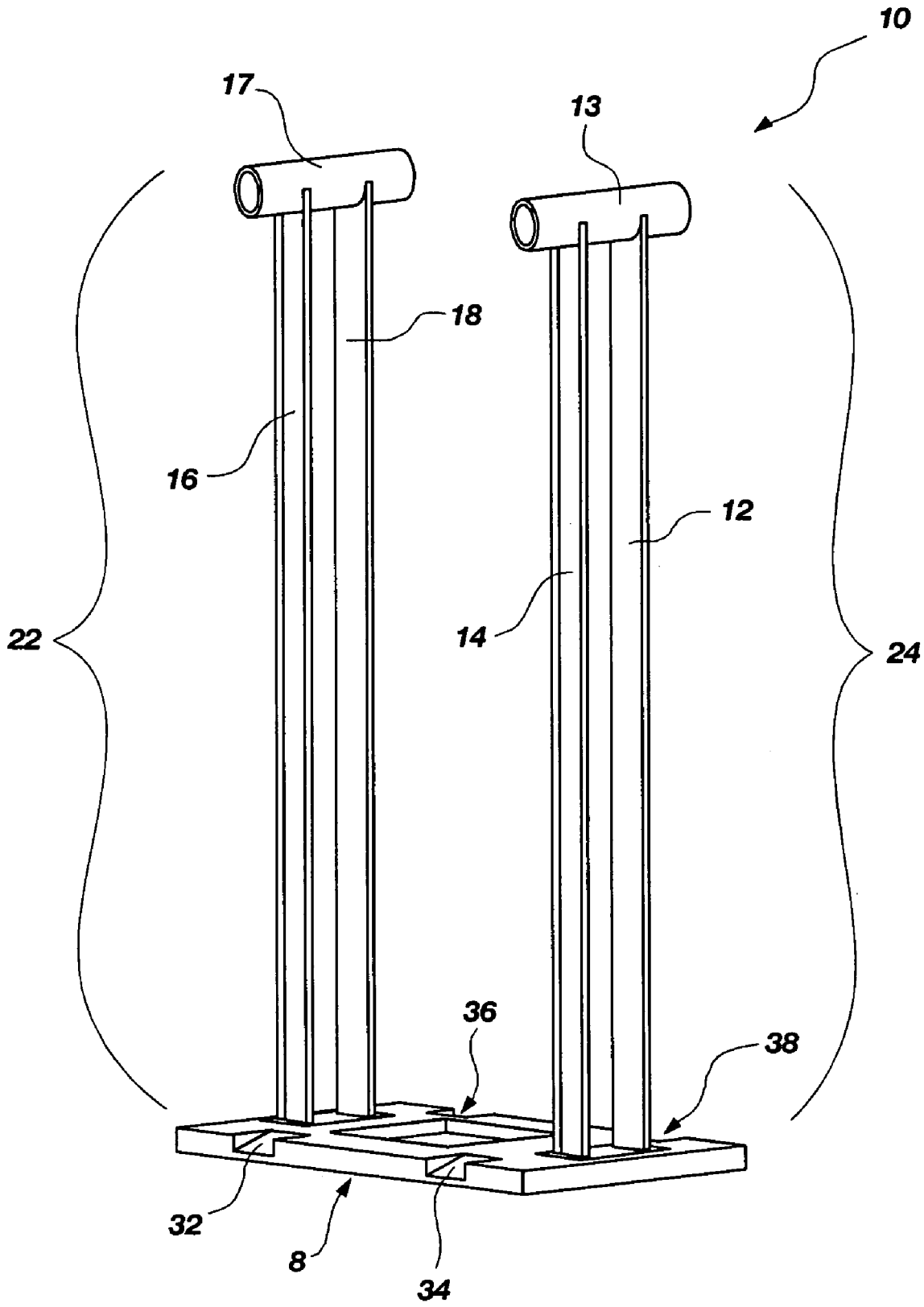
FIG. 1 shows a perspective view of one embodiment of a support frame including a first columnar assembly, a second columnar assembly, and a frame base.

Generally, the present invention relates to lift apparatuses for traversing a change in elevation (e.g., an incline or one or more steps, such as a flight of stairs) by a wheelchair-bound person. In one embodiment, a lift apparatus may include a support frame extending upwardly from a ground surface on which the lift is positioned. Such a lift apparatus may also include a movable platform assembly, which may support the wheels of the wheelchair and which may be movably coupled to the support frame. Further, a transmission may connect the support frame and the movable platform and may be operated to cause the movable platform assembly to move (e.g., to raise or lower) relative to the support frame. For example, a lift apparatus may be operated by moving at least one wheel of a wheelchair or otherwise rotating at least one drive roller operably coupled to the transmission.

Thus, a movable platform assembly may include at least one roller operably connected or coupled to a transmission. The at least one roller may be impelled or driven by at least one wheelchair wheel and may move (i.e., rotate) in response to movement (i.e., rotation) of at least one wheelchair wheel. Movement of the at least one roller may cause the transmission to move the movable platform assembly generally vertically relative to the support frame. Generally, a transmission may comprise at least one chain, at least one sprocket, at least one gear, at least one pulley (e.g., at least one pinion pulley), at least one belt, at least one rope, at least one axle, or any combination of the foregoing, wherein the transmission is configured in a manner that allows the movable platform assembly (in combination with a wheelchair and person supported by the movable platform assembly) to move relative to a support frame. In one embodiment, a transmission may be structured to move the movable platform in response to a torque applied to at least one wheelchair wheel which is substantially equal to, or less than, a torque required to move the wheelchair across a substantially horizontal surface. In another embodiment, a lift apparatus may allow a wheelchair-bound user to apply 12 pounds of force, or less, to at least one wheelchair wheel to cause the lift apparatus to move a wheelchair supported by a moveable platform.

As mentioned above, a lift apparatus according to the present invention may include a support frame. Generally, the support frame may be structured for suitable stability and strength for a selected range of positions of the movable platform. Typically, the support frame may be structured for movement of the movable platform in a substantially vertical direction. However, the present invention contemplates that lift apparatuses may be configured for substantially horizontal motion or along any other selected direction, without limitation. Thus, a support frame may be structured for providing suitable stability and sufficient mechanical strength to support a movable platform coupled to the support frame for movement of the platform relative to the support frame.

In one embodiment, a support frame may include two columns or columnar assemblies extending from a base. For example, FIG. 1 shows a perspective view of a support frame 10 including a first columnar assembly 22 and a second columnar assembly 24 extending from frame base 8. Frame base 8 may optionally include ramp regions 32, 34, 36, 38 for facilitating rolling of a wheelchair or other wheeled object onto the frame base 8. More particularly, columnar assembly 22 comprises columns 16, 18 and cross-brace 17. Similarly, columnar assembly 24 includes columns 12, 14 and cross-brace 13. Columns 16, 18 may be mechanically coupled to frame base 8 and cross-brace 17 as known in the art. For example, columns 16, 18 may be welded, fastened by fastening elements, or otherwise affixed to cross-brace 17 and frame base 8. Similarly, columns 12, 14 of columnar assembly 24 may be affixed to cross-brace 13 and frame base 8 by any of the above-mentioned techniques or as otherwise known in the art. Further, it may be appreciated that columns 12, 14, 16, 18 may comprise at least one structural element such as, for example at least one of the following structural elements: an I-beam, a channel beam, an angle beam, a pipe, a tube, or another structural member as known in the art. In addition, frame base 8 may comprise plate or sheet material that is welded, bent, or otherwise formed, as known in the art. Accordingly, frame base 8 and columnar assemblies 22, 24 may comprise a metal (e.g., steel, aluminum, etc.), a composite (e.g., fiberglass composite, graphite composite, etc.), or any other material as known in the art. Of course, support frame 10 may comprise one or more materials and a structure intended to provide sufficient strength, desired deflection characteristics, corrosion resistance, or other properties of interest.

As mentioned above, the present invention contemplates that a movable platform may be operably coupled to a support frame. More specifically, a movable platform may be configured to move (e.g., slide or roll) relative to at least a portion of a support frame. For instance, bushings, wheels, or other mechanisms configured for facilitating movement between two structures may be positioned between a support frame and a movable platform. Such mechanisms may facilitate movement and positioning of a movable platform with respect to a support frame.

Figure 2:
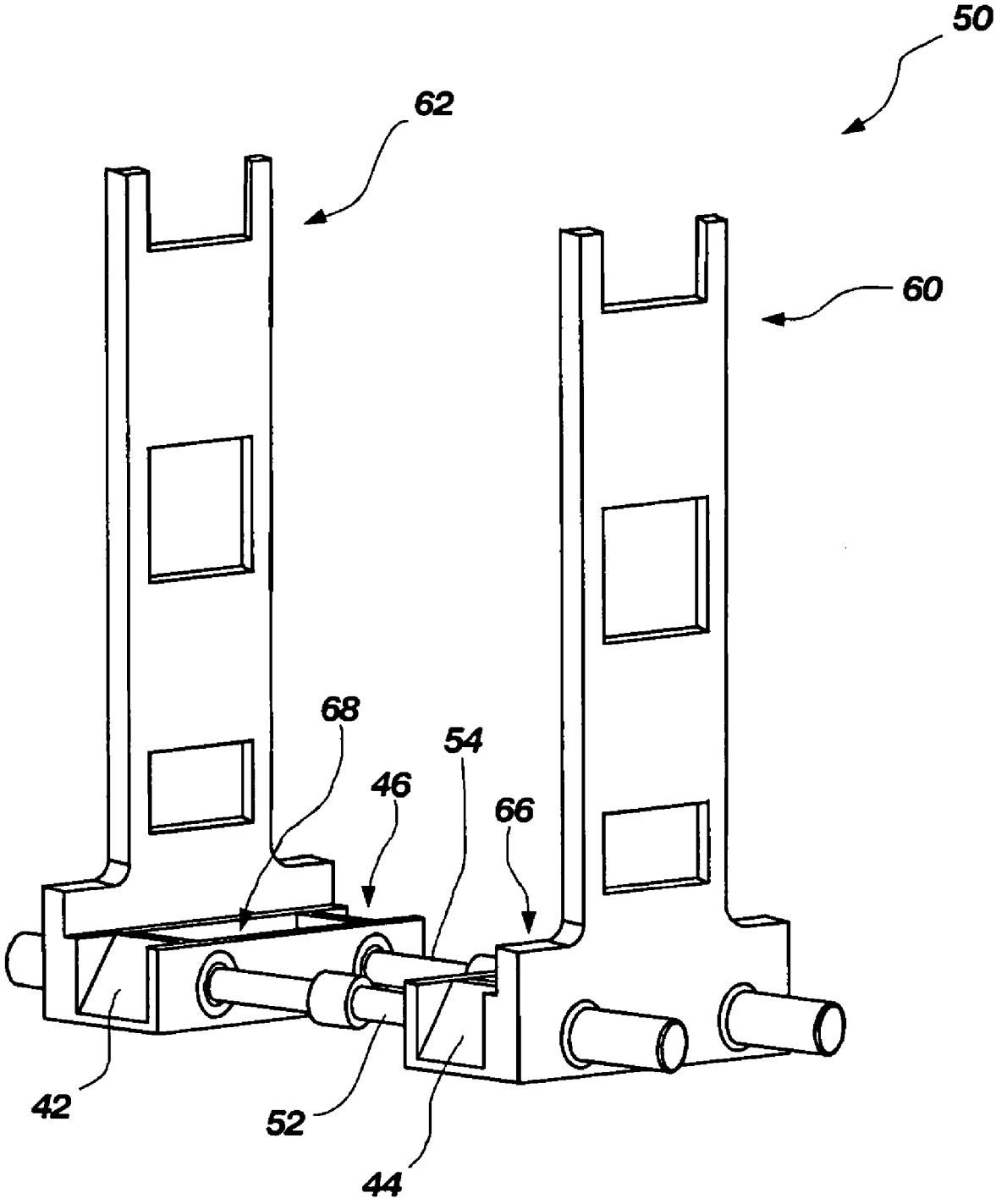
FIG. 2 shows a perspective view of one embodiment of a movable platform including a first platform leg, a second platform leg, and two drive axles.
Figure 3:
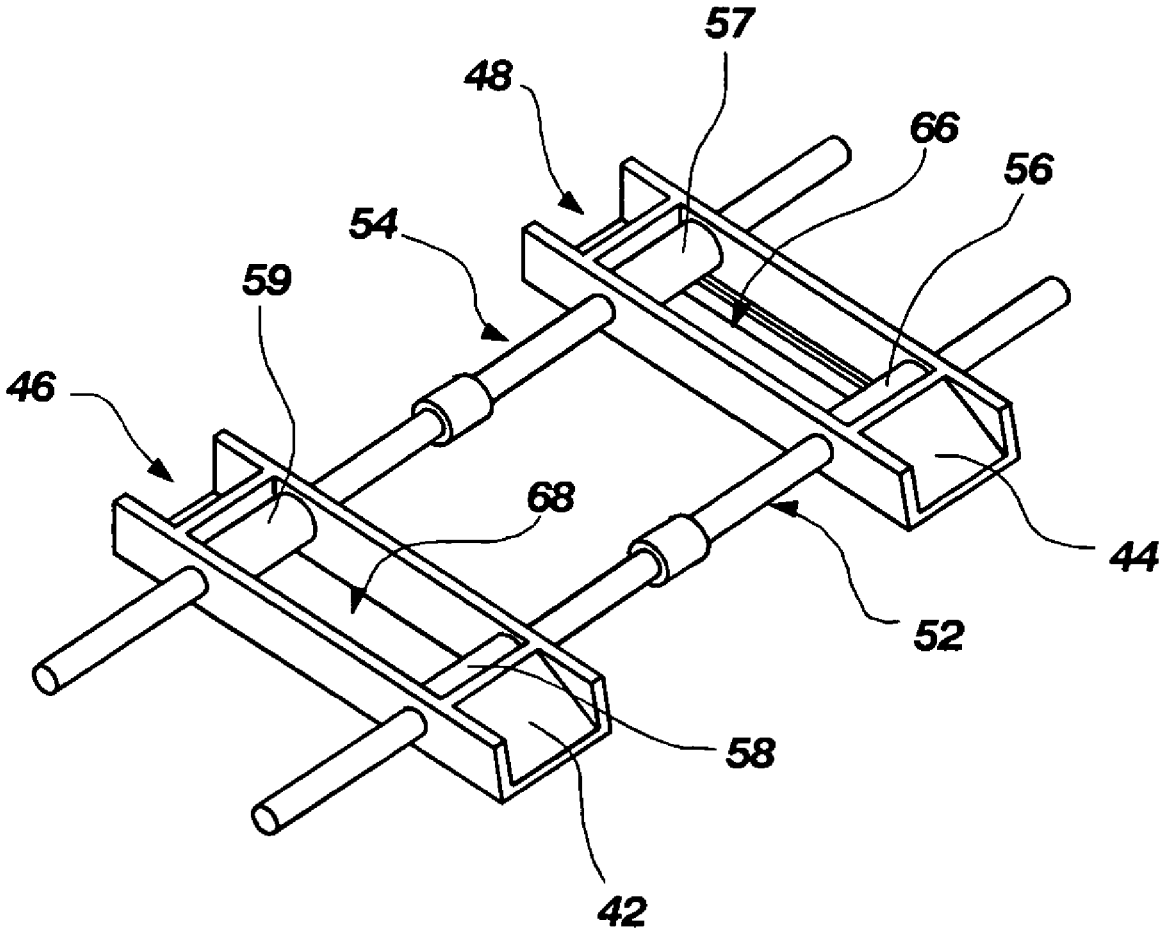
FIG. 3 shows a partial, perspective view of the movable platform shown in FIG. 2.

In one embodiment, a movable platform may comprise two platform legs, which are positioned substantially opposite of one another and two platform axles extending through each of the support legs. For example, FIG. 2 shows a perspective view of a movable platform 50 including support legs 60, 62 and platform axles 52, 54 extending between support legs 60, 62. In addition, FIG. 3 shows a partial, sectioned view of movable platform 50. As shown in FIGS. 2 and 3, support legs 60, 62 may define, respectively, wheel recesses 66, 68. In addition, ramp regions 42, 44, 46, 48 may be formed by support legs 60, 62 to facilitate rolling of a wheelchair or other wheeled object over or onto platform 50. Wheel recesses 66, 68 may be sized and positioned so that wheels of a wheelchair may be positioned (e.g., by rolling over ramp regions 32, 34 of support frame 10 and ramp regions 42, 44 of platform 50) generally within wheel recesses 66, 68, respectively. Furthermore, the present invention contemplates that at least one roller may be coupled to at least one of platform axles 52, 54 and may be configured for rotating in response to contact with at least one wheelchair wheel during rotation of the at least one wheelchair wheel. As shown in FIGS. 2 and 3, optionally, movable platform 50 may include a plurality of rollers 56, 57, 58, 59 that are positioned generally within wheel recesses 66, 68, respectively. Thus, rollers 56, 57 may be configured to support one wheel of a wheelchair and rollers 58, 59 may be configured to support the other wheel of a wheelchair. Further, rotation of both wheels of a wheelchair may cause rollers 56, 57, 58, 59 to rotate.

Of course, it should be appreciated that a single roller coupled to a platform axle may be rotated in response to rotation of a rear wheel of a wheelchair, if desired, without limitation. Put another way, the present invention contemplates that a moveable platform may include at least one roller that is operably coupled to a transmission, as discussed below, without limitation. For example, accordingly, it should be understood that platform axle 54 of movable platform 50 may be omitted; accordingly, in another embodiment, platform axle 52 may include only roller 56, which is operably coupled to a transmission. Of course, if each wheel of a wheelchair may be independently rotated, only the wheel interacting with the roller 56 may be rotated. Otherwise, if both drive wheels of a wheelchair are rotated simultaneously, the wheel that is not interacting with the roller may be supported by a rolling or sliding mechanism or the axle of the wheelchair wheel may be supported to avoid contact of the noninteracting wheel with the movable platform.

As mentioned above, the present invention contemplates that a transmission may mechanically connect or couple a movable platform to a support frame. Such a transmission may include any mechanical components known in the art that may be useful for causing a movable platform assembly to move relative to a support frame. As mentioned above, a transmission may comprise at least one chain, at least one sprocket, at least one gear, at least one pulley, at least one belt, at least one rope, at least one axle, or any combination of the foregoing, without limitation. It may be understood that such a transmission may generate a mechanical advantage. For example, a transmission may be configured to generate a force for moving the movable platform of at least about 50 times (i.e., a mechanical advantage of at least about 50) a force applied to at least one roller of the movable platform. Such a configuration may provide sufficient force for substantially vertically lifting (e.g., against an earthly gravitational force) a platform, a wheelchair, and a wheelchair occupant with respect to a support frame.

Figure 4:
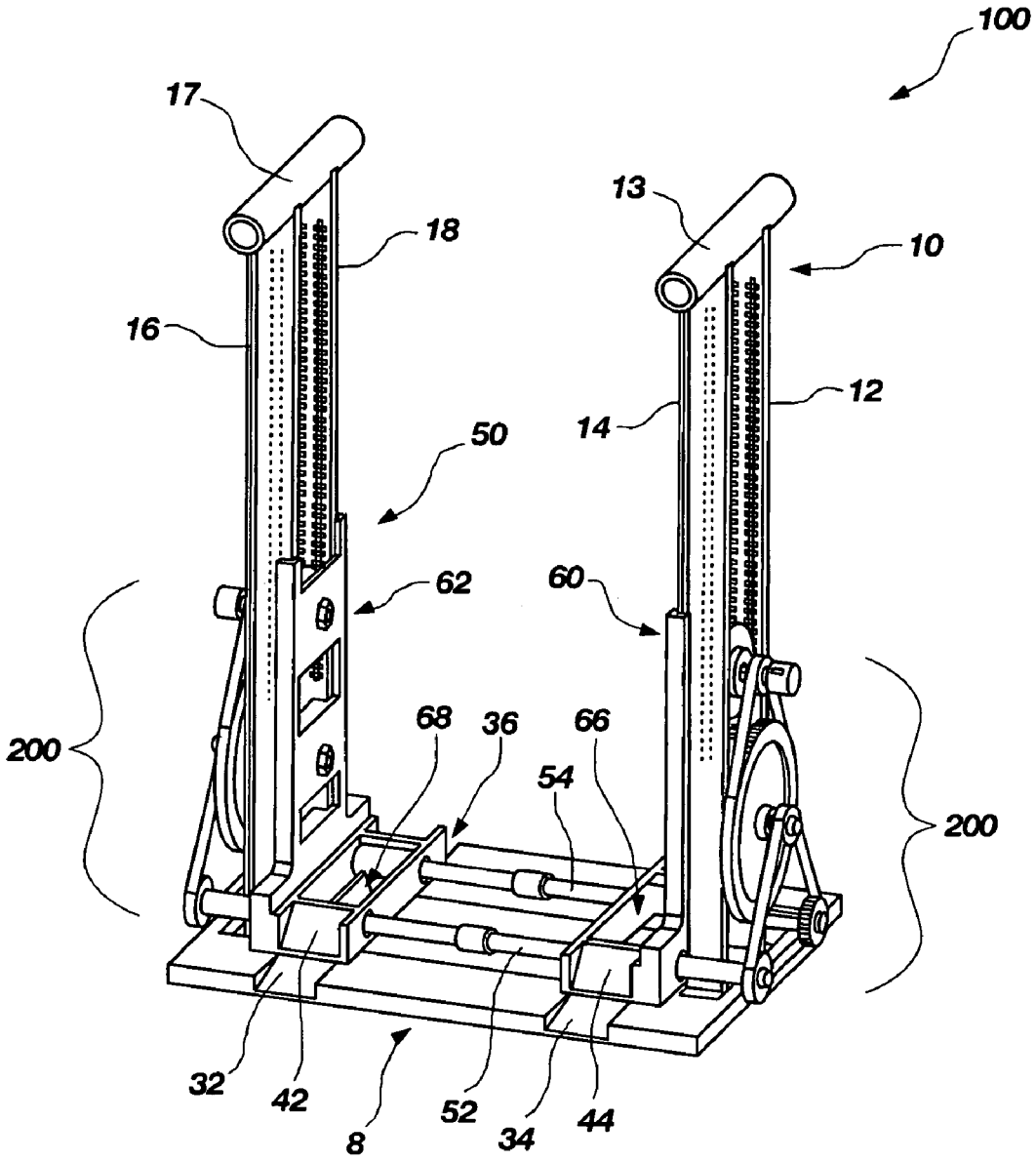
FIG. 4 shows a perspective view of a lift apparatus including a support frame as shown in FIG. 1 and a movable platform as shown in FIGS. 2 and 3.
Figure 5:
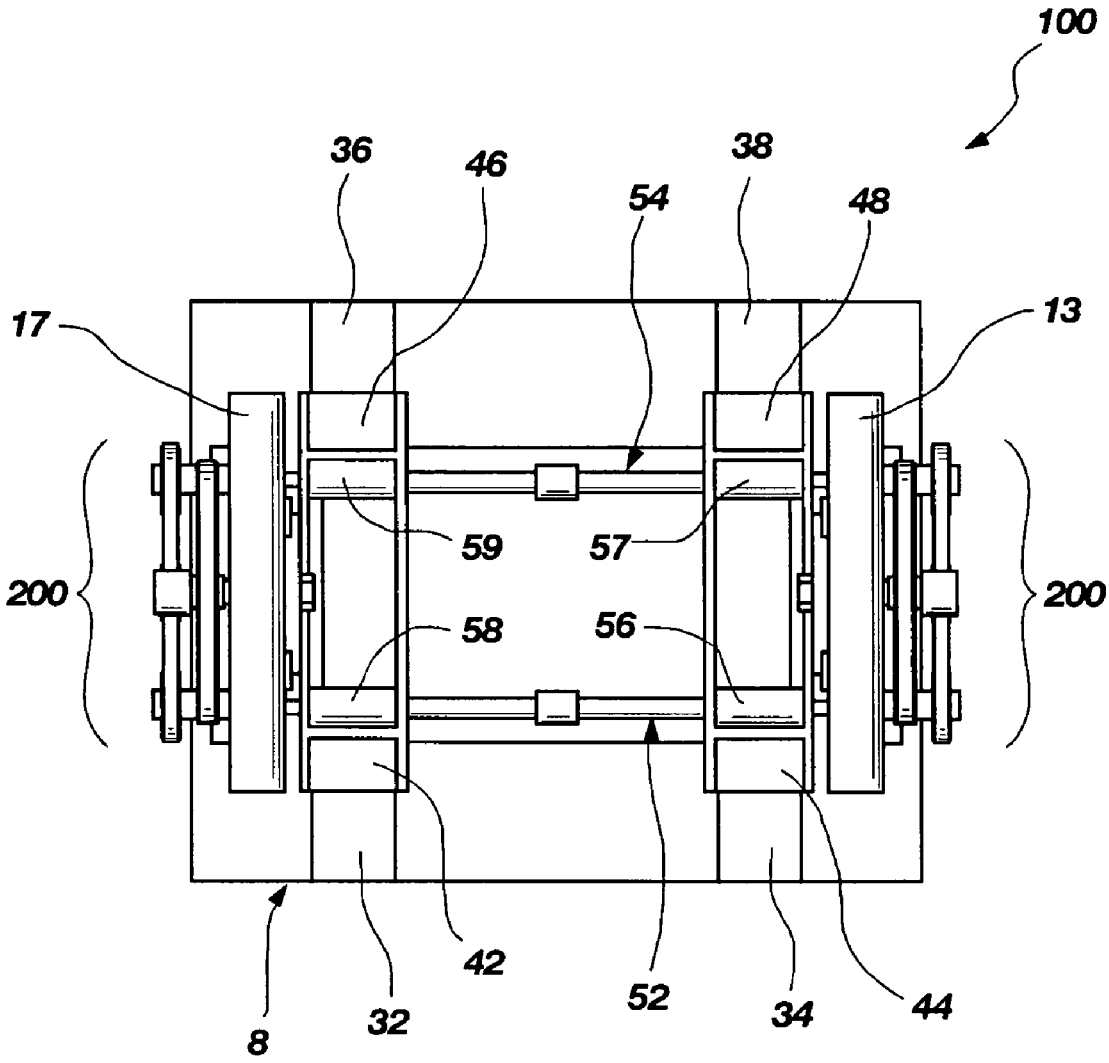
FIG. 5 shows a top elevation view of the lift apparatus shown in FIG. 4.

FIGS. 4 and 5 show a perspective view and a top elevation view of a lift apparatus 100 including a platform 50 coupled to a support frame 10. Further, a transmission couples platform 50 to support frame 10. More particularly, each of support legs 60, 62 may include a substantially identical transmission 200. Put another way, a transmission may comprise two sub-assemblies, wherein the two sub-assemblies (e.g., separate transmissions 200, respectively) are coupled to each of the columnar assembly 22 and columnar assembly 24, respectively. Such a configuration may provide a relatively stable, robust, and balanced transmission for coupling platform 50 to support frame 10 to form lift apparatus 100.

Figure 6:
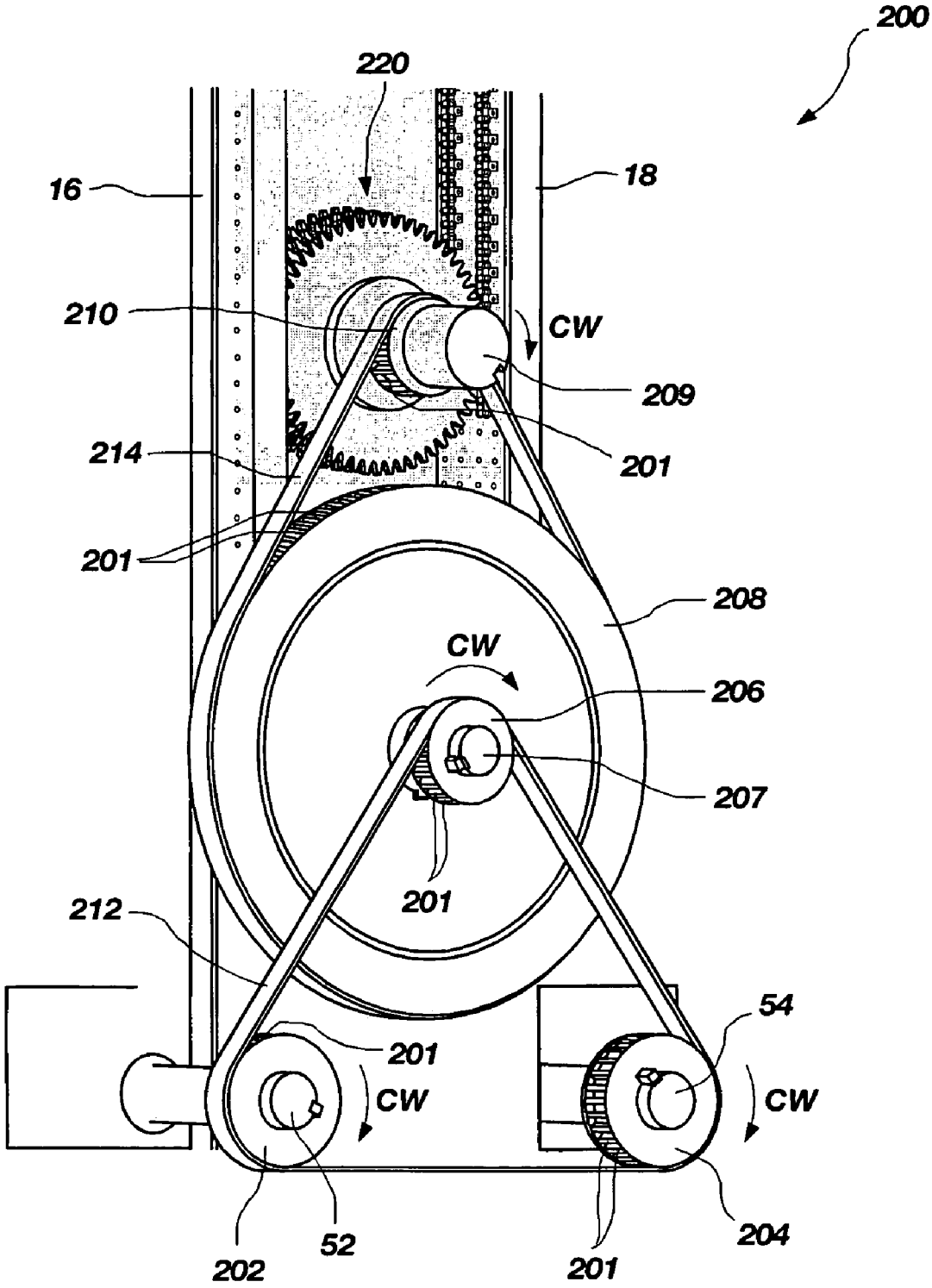
FIG. 6 shows a partial, perspective view of one embodiment of the transmission, shown in FIGS. 4 and 5.
Figure 7:
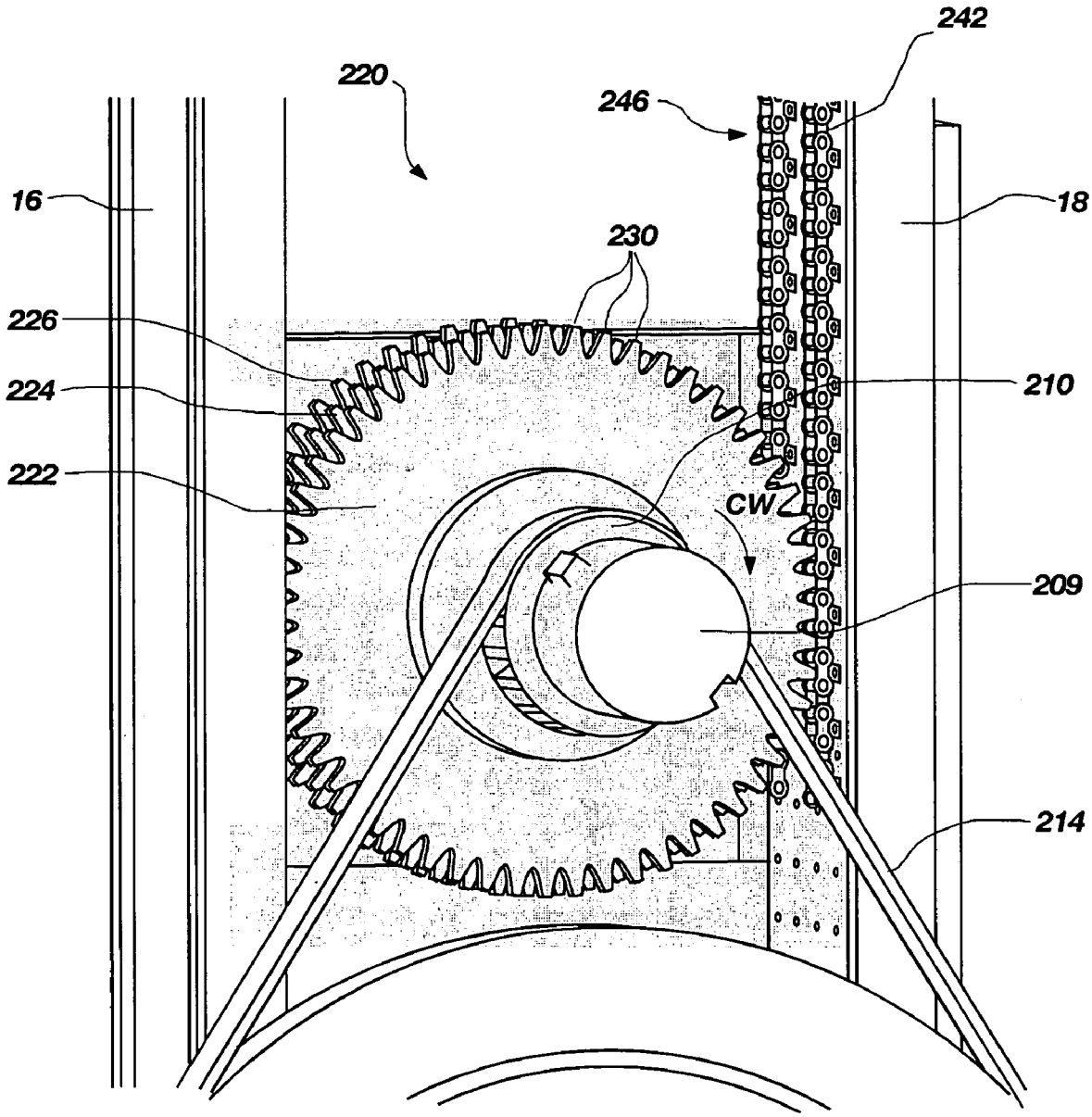
FIG. 7 shows a partial, enlarged, perspective view of the transmission shown in FIG. 6.
Figure 8:
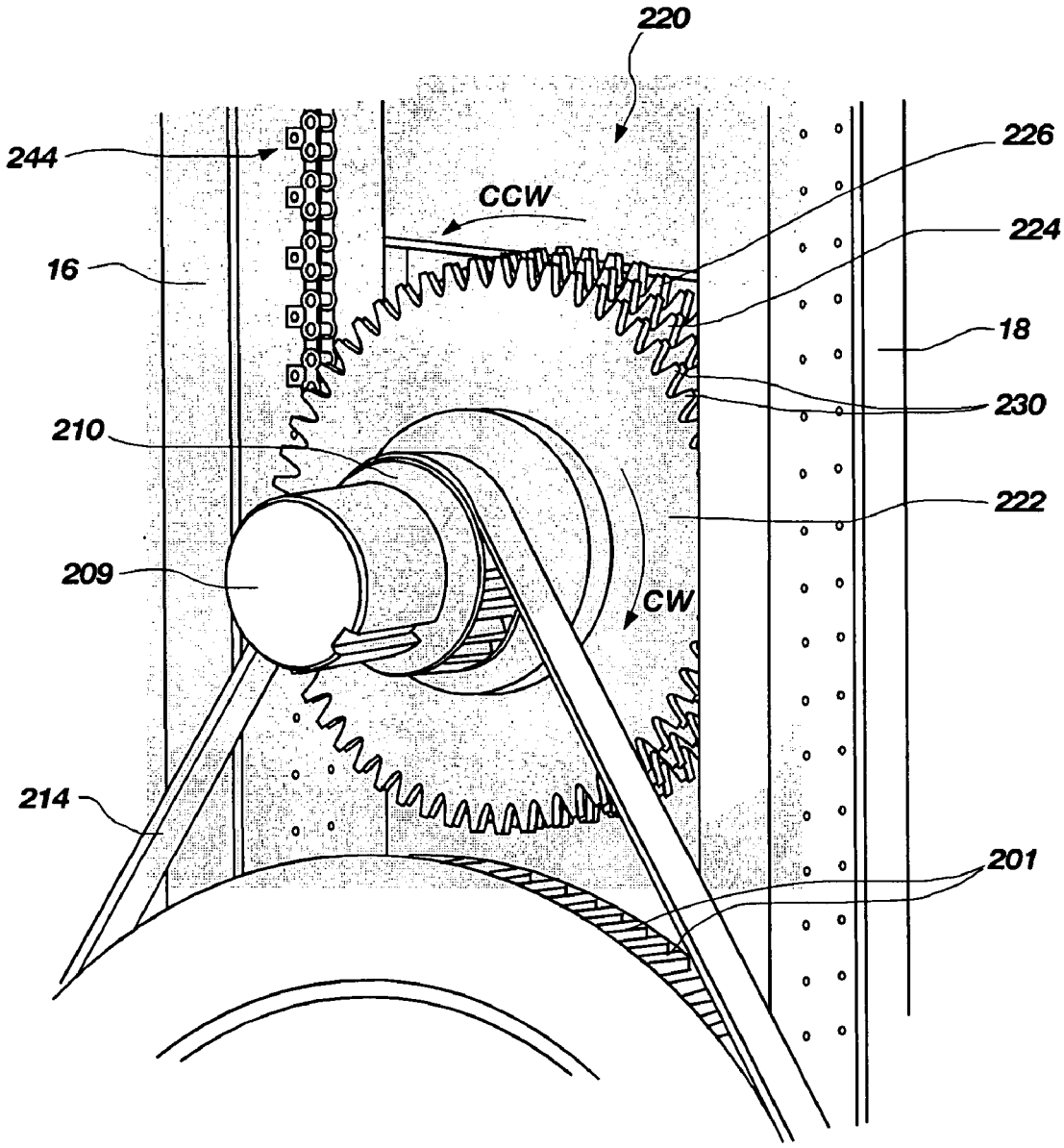
FIG. 8 shows another partial, enlarged, perspective view of the transmission shown in FIG. 6.

In further detail, FIG. 6 shows a perspective view of one embodiment of transmission 200. Platform axle 52 may include drive pulley 202, which is positioned generally at a respective end of platform axle 52. Similarly, platform axle 54 may include drive pulley 204, which is positioned generally at a respective end of drive axle 54. Further, transmission 200 includes a lower drive belt 212, a first intermediate pulley 206, a second intermediate pulley 208, an upper drive belt 214, a sprocket pulley 210, a sprocket assembly 220, an outer chain 242 (FIG. 7), an inner chain 246 (FIG. 7), and an idler chain 244 (FIG. 8). Pulleys 202, 204, 206, 208 may be coupled to a respective axle of axles 52, 54, 207, 209 by a keyway and key type coupling, welding, fastening elements (e.g., pins, threaded bolts or screws, etc.), or as otherwise known in the art. As shown in FIG. 6, drive pulley 202, drive pulley 204, first intermediate pulley 206, second intermediate pulley 208, and sprocket pulley 210 may each comprise a so-called "pinion pulley." Thus, as shown in FIG. 6, each of these pulleys include teeth 201 arranged generally about the circumference of each pulley, respectively. In addition, lower drive belt 212 and upper drive belt 214 may each be configured as a so-called "timing belt" that includes a series of teeth and grooves that are spaced to mesh with drive pulley 202, drive pulley 204, first intermediate pulley 206, second intermediate pulley 208, and sprocket pulley 210, respectively. Accordingly, as shown in FIG. 6, rotation of drive pulley 202 and drive pulley 204 in a direction labeled CW results in first intermediate pulley 206, second intermediate pulley 208, and sprocket pulley 210 rotating in direction labeled CW. Of course, any pulley, gear, or sprocket in combination with elongated transmissive elements, such as, for instance, belts, ropes, or chains may be included by a transmission, without limitation.

Figure 8A:
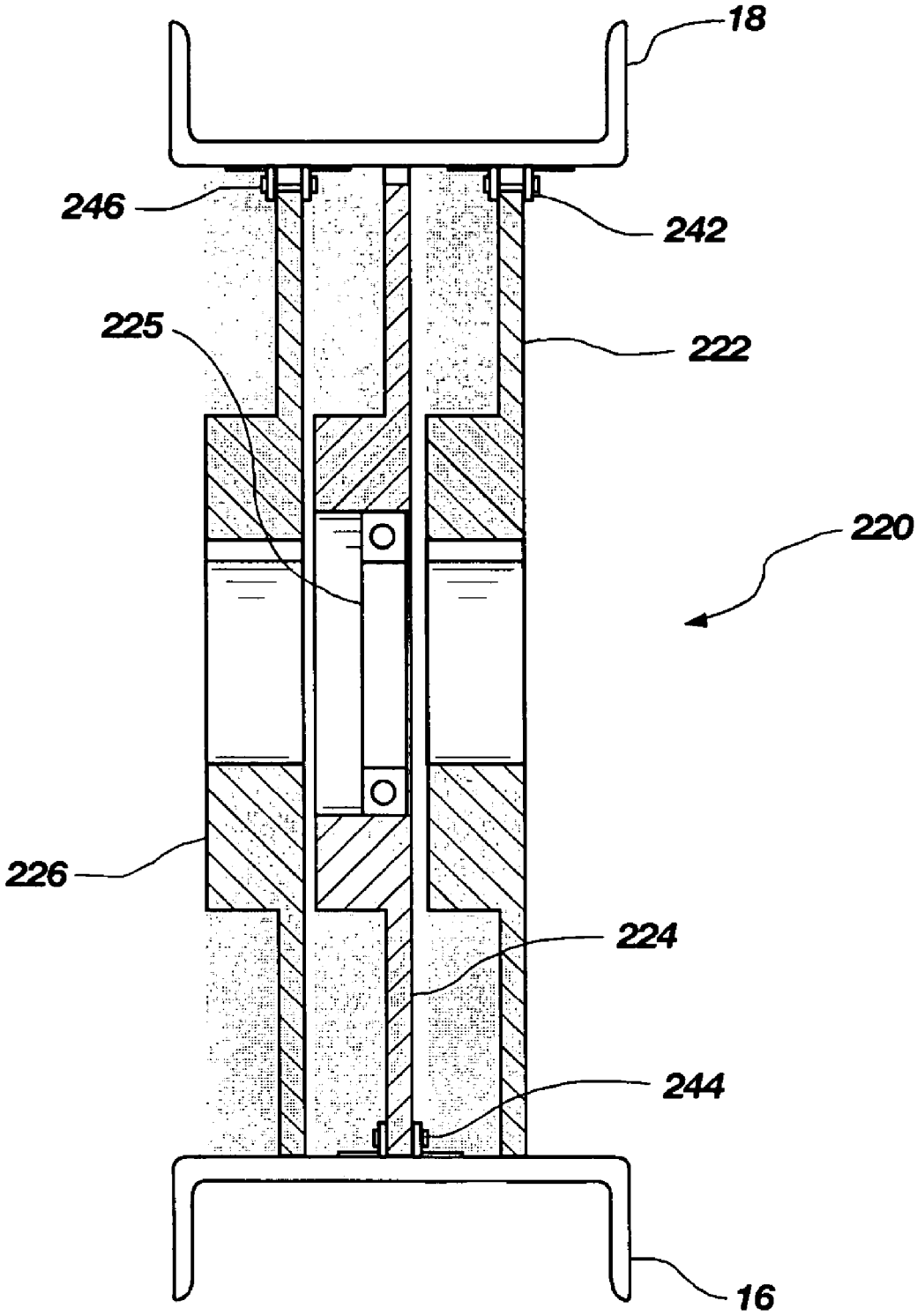
FIG. 8A shows a top view of the sprocket assembly and chains.

In further detail, sprocket assembly 220 may include an outer drive sprocket 222, an idler sprocket 224, and an inner drive sprocket 226. Further, each of outer drive sprocket 222 and inner drive sprocket 226 may be coupled to sprocket axle 209 so that rotation of sprocket axle 209 causes rotation of both outer drive sprocket 222 and inner drive sprocket 226. For example, in one embodiment a keyway and key type coupling may couple sprocket axle 209 to each of inner drive sprocket 226 and outer drive sprocket 222. Optionally, each of outer drive sprocket 222 and inner drive sprocket 226 may be coupled to sprocket axle 209 by welding, fastening elements (e.g., pins, threaded bolts or screws, etc.), or as otherwise known in the art. Idler sprocket 224 may be configured to rotate freely with respect to sprocket axle 209. For example, as discussed below, a roller bearing may suitably couple sprocket axle 209 and idler sprocket 224. Of course, other mechanisms (e.g., bushings or other bearings) may be employed for allowing rotation of sprocket axle 209 and idler sprocket 224 relative to one another. Thus, as may be appreciated with reference to FIG. 6, rotation of sprocket axle 209 may cause outer drive sprocket 222 and inner drive sprocket 226 to rotate in the same direction. Thus, sprocket teeth 230 of outer drive sprocket 222 and inner drive sprocket 226 may be caused to mesh or otherwise couple or engage to outer chain 242 and inner chain 246, respectively. Explaining further, FIGS. 7 and 8 show perspective views of sprocket assembly 220 and idler chain 244. FIG. 8A shows a top view of the sprocket assembly 220 and chains 242, 244, 246. Upon rotation of sprocket axle 209 in a direction CW, idler sprocket 224 may rotate in a direction CCW (i.e., an opposite direction of rotation of sprocket axle 209) via roller bearing 225 (FIG. 8A) and may mesh with or otherwise couple or engage to idler chain 244, as shown in FIGS. 7, 8, and 8A. Thus, at least one roller may be used to cause the sprocket assembly 220 and movable platform to move relative to support frame 10. Such a sprocket assembly 220 may provide a relatively robust and stable mechanism for transforming a torque applied to at least one roller into a lifting force for lifting the movable platform 50, a wheelchair positioned upon the movable platform 50, and an occupant of the wheelchair. In one embodiment, the above-described transmission 200 may generate at least about 600 pounds of force for moving the platform assembly substantially vertically in response to application of about 12 pounds of force applied tangentially to rollers 56 and 57. Of course, each transmission 200 may generate such a mechanical advantage; therefore, a force of about 12 pounds applied tangentially to rollers 56, 57, 58, 59 may produce a total vertical force of at least about 1,200 pounds. By way of example, a conventional wheelchair may require approximately 12 pounds of force applied tangentially to its wheels in order to traverse a substantially horizontal surface. In this manner, the operator of the wheelchair can raise the lift using the same force normally exerted to traverse horizontal surfaces.

As discussed above, lift apparatus 100 may be operated so that movable platform 50 is selectively positioned relative to support frame 10. More particularly, at least one wheel of a wheelchair may interact with at least one roller of the movable platform 50 and may drive transmissions 200 that couple support frame 10 and movable platform 50. Of course, rotation of at least one wheelchair wheel may be caused by a user of the wheelchair, by an electric motor (e.g., in the case of an electric wheelchair), or as otherwise known in the art. It should also be appreciated that a lift apparatus may be utilized and operated by various wheeled objects (e.g., carts, or other wheeled devices for enhancing mobility of a person).

Figure 9:
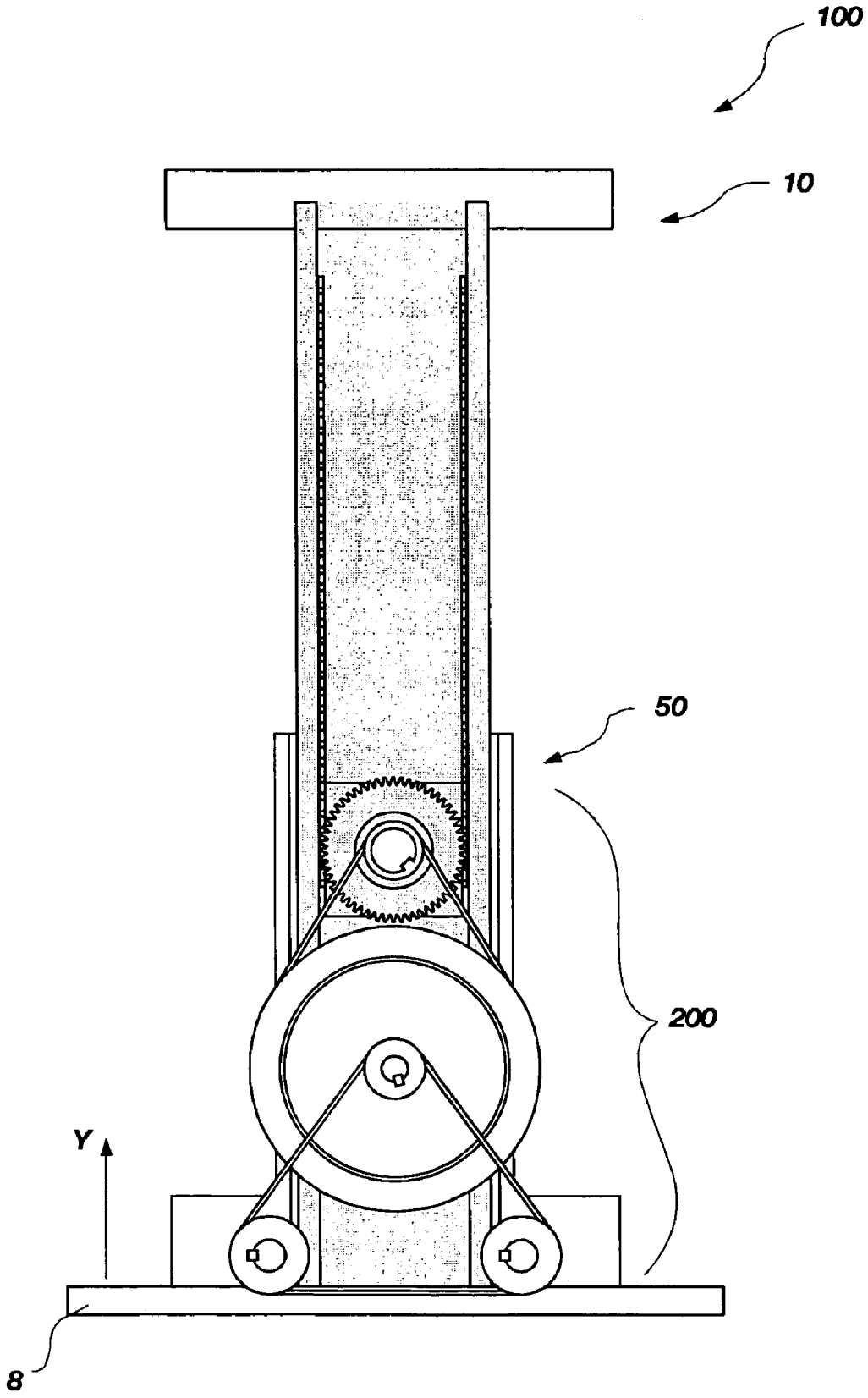
FIG. 9 shows a side view of the embodiment of the lift apparatus shown in FIG. 4, wherein the movable platform is positioned adjacent to the frame base of the support frame.
Figure 10:
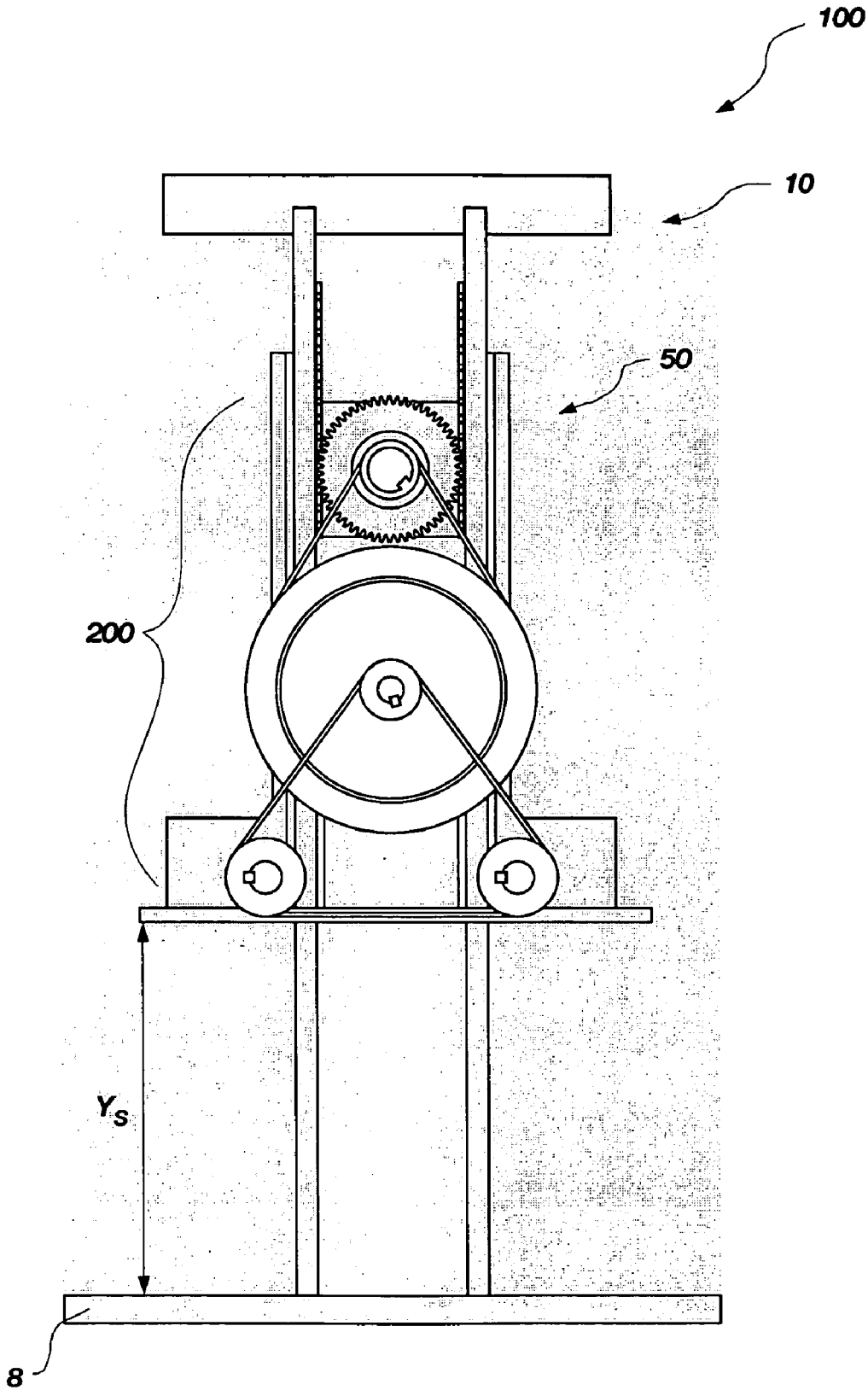
FIG. 10 shows a side view of the embodiment of the lift apparatus shown in FIG. 4, wherein the movable platform is positioned at a selected distance relative to the frame base of the support frame.

FIG. 9 shows a side view of lift apparatus 100, where movable platform 50 may be moved generally in direction Y with respect to frame base 8 to a selected position. For example, as shown in FIG. 10, movable platform 50 may be positioned at a selected position $Y_s$ with respect to frame base 8. Accordingly, it may be appreciated that lift apparatus 100 may be advantageous for moving (e.g., changing an elevation of) a wheelchair and a person positioned in the wheelchair. For example, the present invention contemplates that lift apparatus 100 may be operated to move a person in a wheelchair between two different elevations. In addition, optionally, the present invention contemplates that a lift apparatus 100 may be operably coupled to a ramp system, as discussed in greater detail below.

Figure 11:
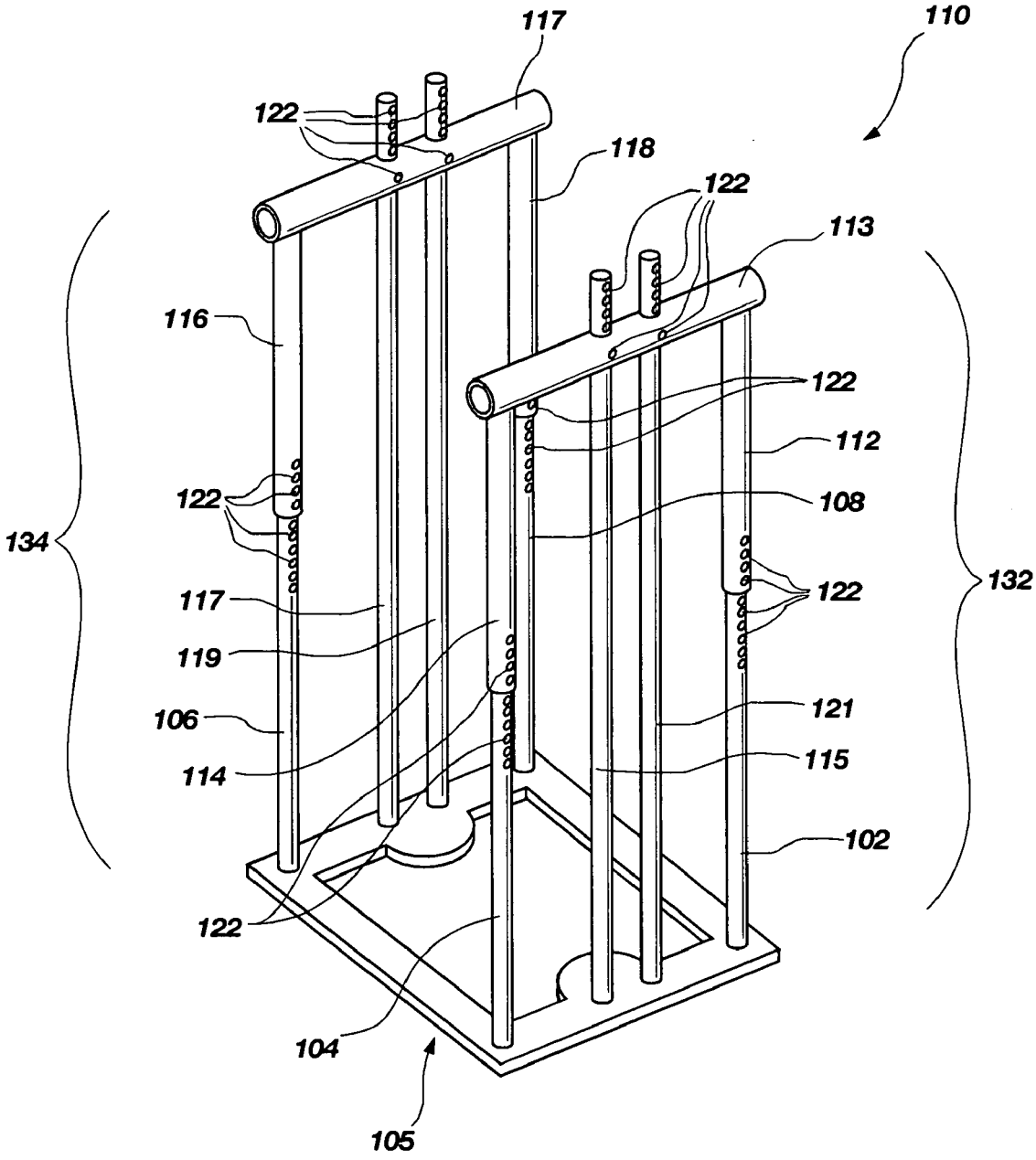
FIG. 11 shows a perspective view of another embodiment of a support frame.

Of course, the present invention contemplates many various embodiments relative to a support frame, a movable platform, and a transmission coupling the movable platform to the support frame. For example, FIG. 11 shows a perspective view of a support frame 110 including a frame base 105 and a plurality of columns extending from the frame base 105. Explaining further, a first plurality of columns may extend from frame base 105 to form a first columnar assembly 134 and a second plurality of columns may extend from frame base 105 to form a second columnar assembly 132. As shown in FIG. 11, columnar assembly 134 assembly may include columns 116 and 118, which are both affixed to cross brace 117 and wherein at least a portion of each of columns 116, 118 may be positioned over or otherwise overlap with at least a portion of each of columns 106, 108, respectively. Similarly, a second columnar assembly 134 of support frame 110 may include columns 112, 114 affixed to cross brace 113 wherein columns 112, 114 may be positioned over or may otherwise at least partially overlap with columns 121, 115, respectively. As shown in FIG. 11, columns 116, 118 and columns 112, 114 may be selectively positionable with respect to columns 106, 108 and columns 102, 104, respectively. More specifically, in one embodiment, a plurality of holes 122 may be formed in each of columns 116, 118, 106, 108, 102, 104, 112, 114 and a fastening element (e.g., a pin, a bolt, a screw, etc.) may be positioned within selected, aligned holes 122 so that columns 116, 118 may be positioned with respect to columns 106, 108 and columns 114, 112 may be positioned with respect to columns 102, 104. Such a configuration may allow for adjustability relative to a range of elevations at which a movable platform coupled to the support frame 110 may be positioned.

Figure 12:
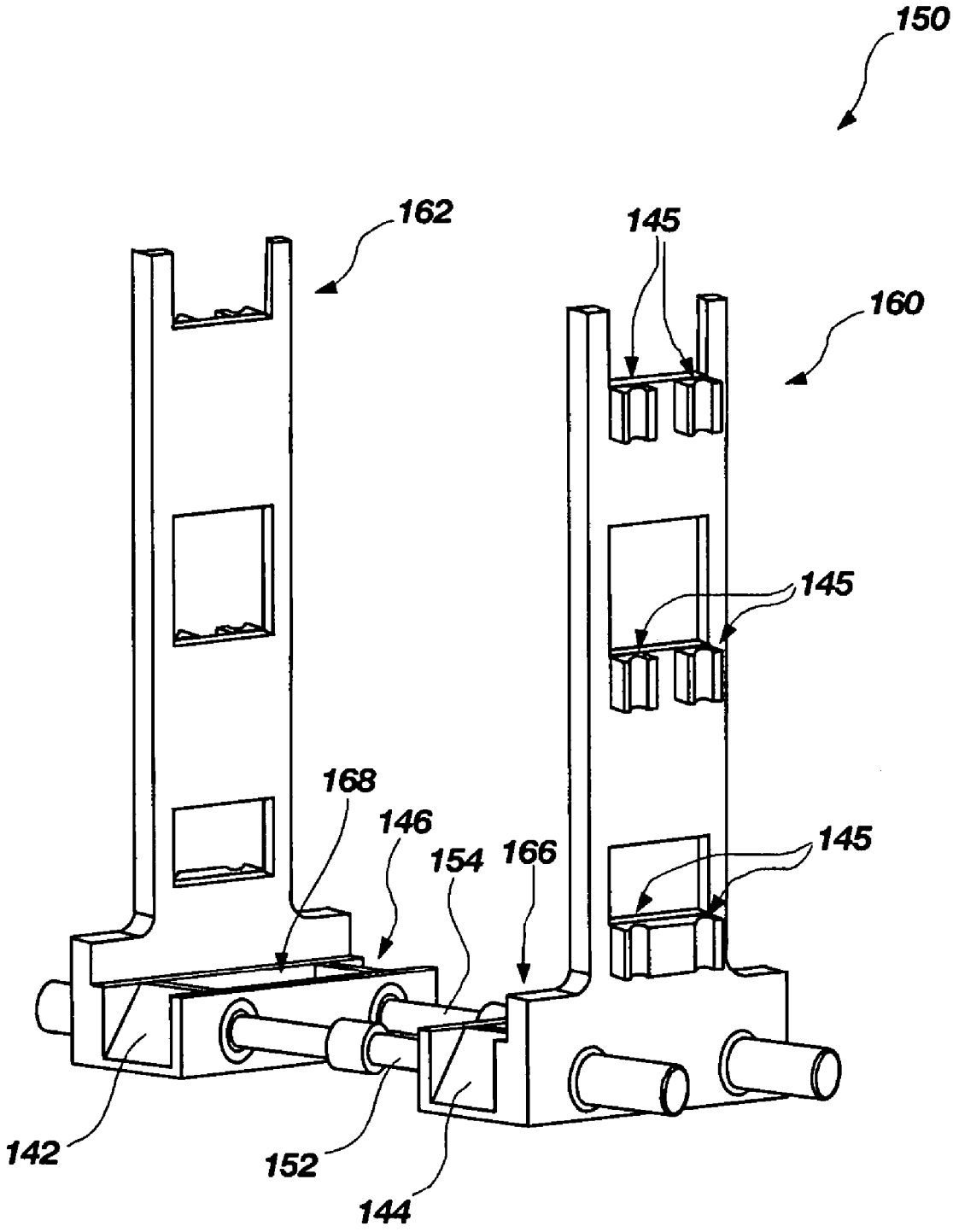
FIG. 12 shows a perspective view of another embodiment of a movable platform including a first platform leg, a second platform leg, and two drive axles, wherein each of the drive axles extend s through both of the platform legs.

There are many movable platform embodiments contemplated by the present invention which may be coupled to a support frame 110 as shown in FIG. 11. For example, FIG. 12 shows a perspective view of one embodiment of a movable platform 150 including platform legs 160, 162 and a plurality of arcuate recesses 145 that are formed in a side region of each of platform legs 160, 162. Such arcuate recesses 145 may be configured for alignment with columns 115, 121 and columns 117, 119 of support frame 110, respectively. Of course, optionally, linear bearings, bushings, sacrificial wear coatings or elements (e.g., TEFLON®, nylon, bronze etc.) or other structures as known in the art for facilitating relative motion between two surfaces (i.e., arcuate recesses 145 and columns 115, 121, 117, 119, respectively) may be positioned between arcuate recesses 145 and columns 115, 121, 117, 119.

Figure 13:
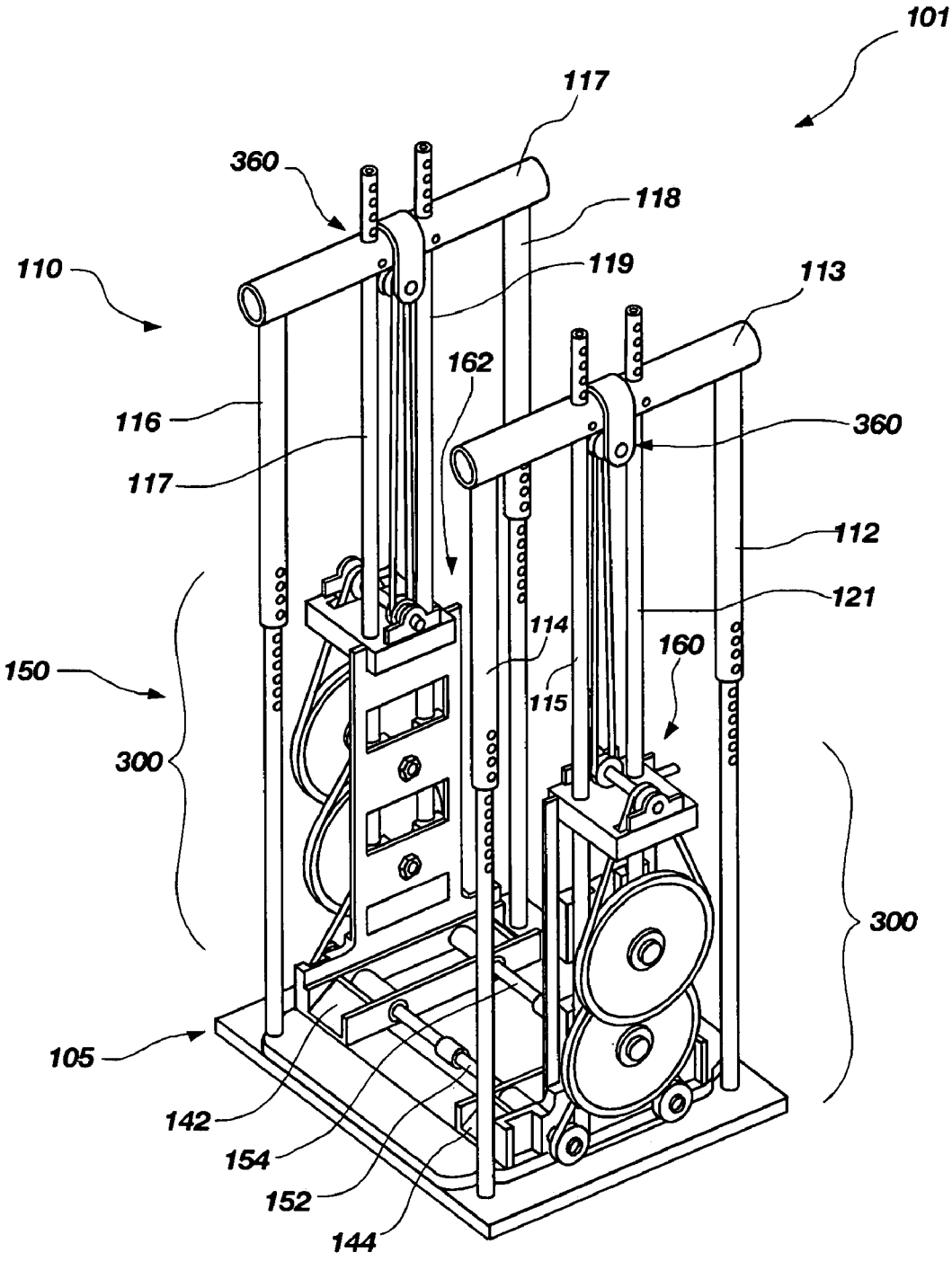
FIG. 13 shows a perspective view of one embodiment of a lift apparatus including the support frame shown in FIG. 11 and the movable platform shown in FIG. 12.

The present invention further contemplates that movable platform 150 may be operably coupled to support frame 110 via a transmission configured for moving the movable platform 150 with respect support frame 110. For example, FIG. 13 shows a perspective view of one embodiment of a lift apparatus 101 including a movable platform 150 coupled to a support frame 110 via a transmission. In addition, generally, movable platform 150 may include at least one roller operably coupled to the transmission. Similar to lift apparatus 100, as described above, in one embodiment, a transmission may comprise two sub-assemblies, wherein the two sub-assemblies (e.g., separate transmissions 300, respectively) are coupled to columnar assemblies 132, 134 of the support frame 110. More particularly, each of support legs 160, 162 may include substantially identical transmissions 300. Further, as shown in FIG. 13, movable platform 150 may include rollers 156, 157, 158, 159. Such rollers 156, 157, 158, 159 may be positioned generally within wheel recesses 166, 168 and may be structured for supporting a wide variety wheelchair wheel shapes and sizes. Thus, a wheelchair may be moved over frame base 105 and along ramp regions 142, 144 until a portion of at least one wheel of the wheelchair contacts or otherwise interacts with at least one roller positioned generally within at least one of wheel recesses 166, 168. For example, rotation of at least one wheel of the wheelchair contacting the at least one roller may cause transmission 300 to move the movable platform 150 relative to support frame 110.

Figure 14:
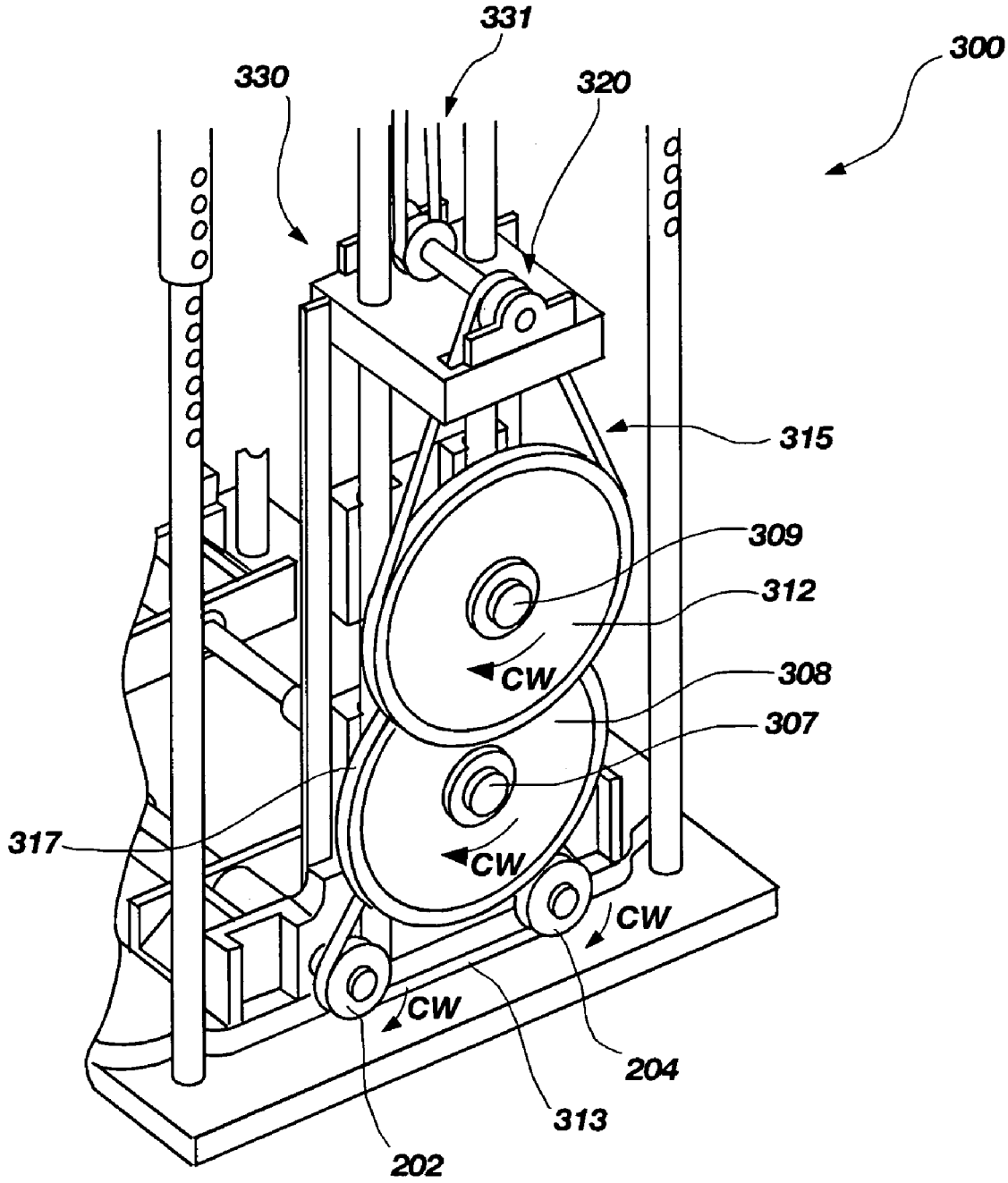
FIG. 14 shows a partial, perspective view of a transmission as shown in FIG. 13.
Figure 15:
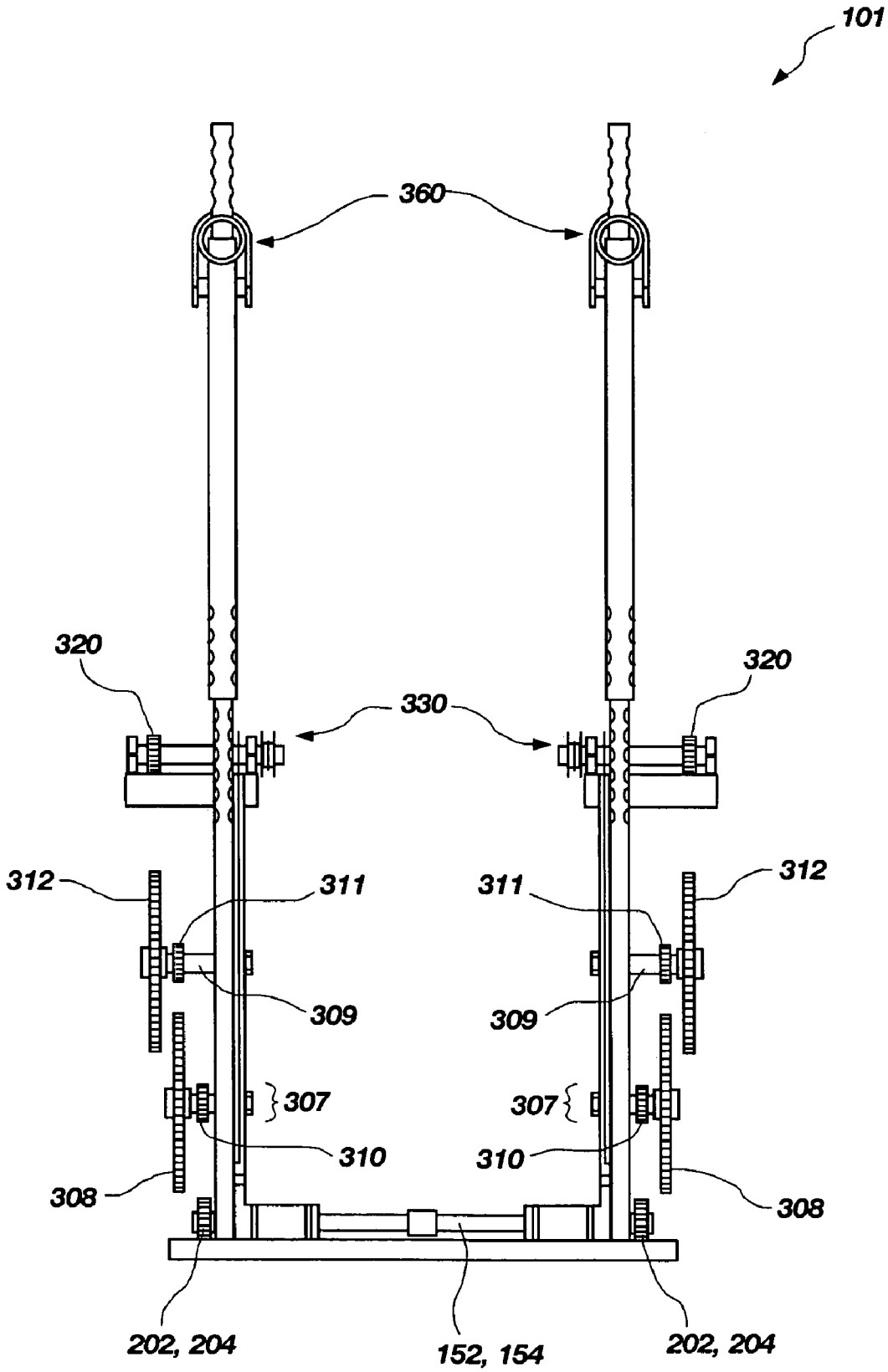
FIG. 15 shows an end view of the lift apparatus shown in FIG. 13.

In further detail, FIGS. 14 and 15 show a partial perspective view of transmission 300 and an end view of lift apparatus 101 depicting various components of transmission 300, respectively. As shown in FIG. 14, transmission 300 may generally include drive pulleys 202, 204, a lower drive belt 313, a first intermediate pulley 310 and a second intermediate pulley 308 coupled to a first intermediate axle 307, a third intermediate pulley 311 and a fourth intermediate pulley 312 coupled to a second intermediate axle 309, an intermediate drive belt 317, a cable pulley assembly 330, and an upper drive belt 315. In addition, a cable 331 may extend between cable pulley assembly 330 and an upper lift pulley 360. Thus, as drive pulleys 202, 204 rotate, first intermediate pulley 310, second intermediate pulley 308 coupled to a first intermediate axle 307, third intermediate pulley 311, fourth intermediate pulley 312, and cable drive pulley 320 may rotate to cause shortening or lengthening of cable 331 extending between cable pulley assembly 330 and upper lift pulley 360. Accordingly, movable platform 150 may move relative to support frame 110.

It may further be appreciated that the present invention contemplates that, optionally, a portion of the support frame may be adjustable or movable. For example, the present invention contemplates that it may be advantageous to rotate the support frame. Such a configuration may allow for positioning the movable platform at a plurality of different exit or entrance regions, if desired. Further, the present invention contemplates that at least a portion of a support frame (e.g., at least one column or columnar assembly) may be configured to tilt, or otherwise distort or rotate to provide access to a plurality of different exit or entrance regions, if desired, without limitation.

Figure 16:
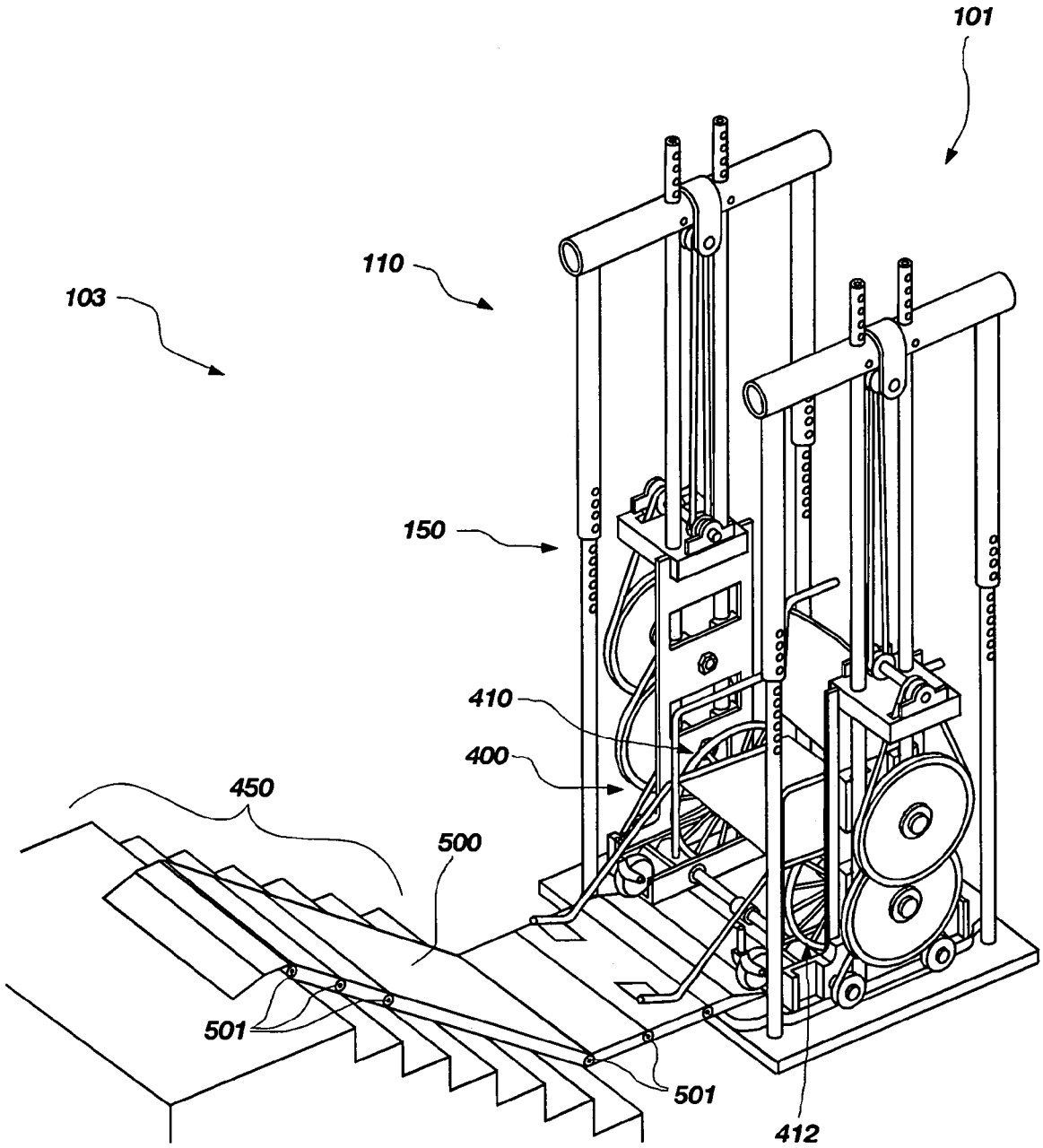
FIG. 16 shows a perspective view of a lift system including the lift apparatus shown in FIG. 13 and a ramp system.
Figure 17:
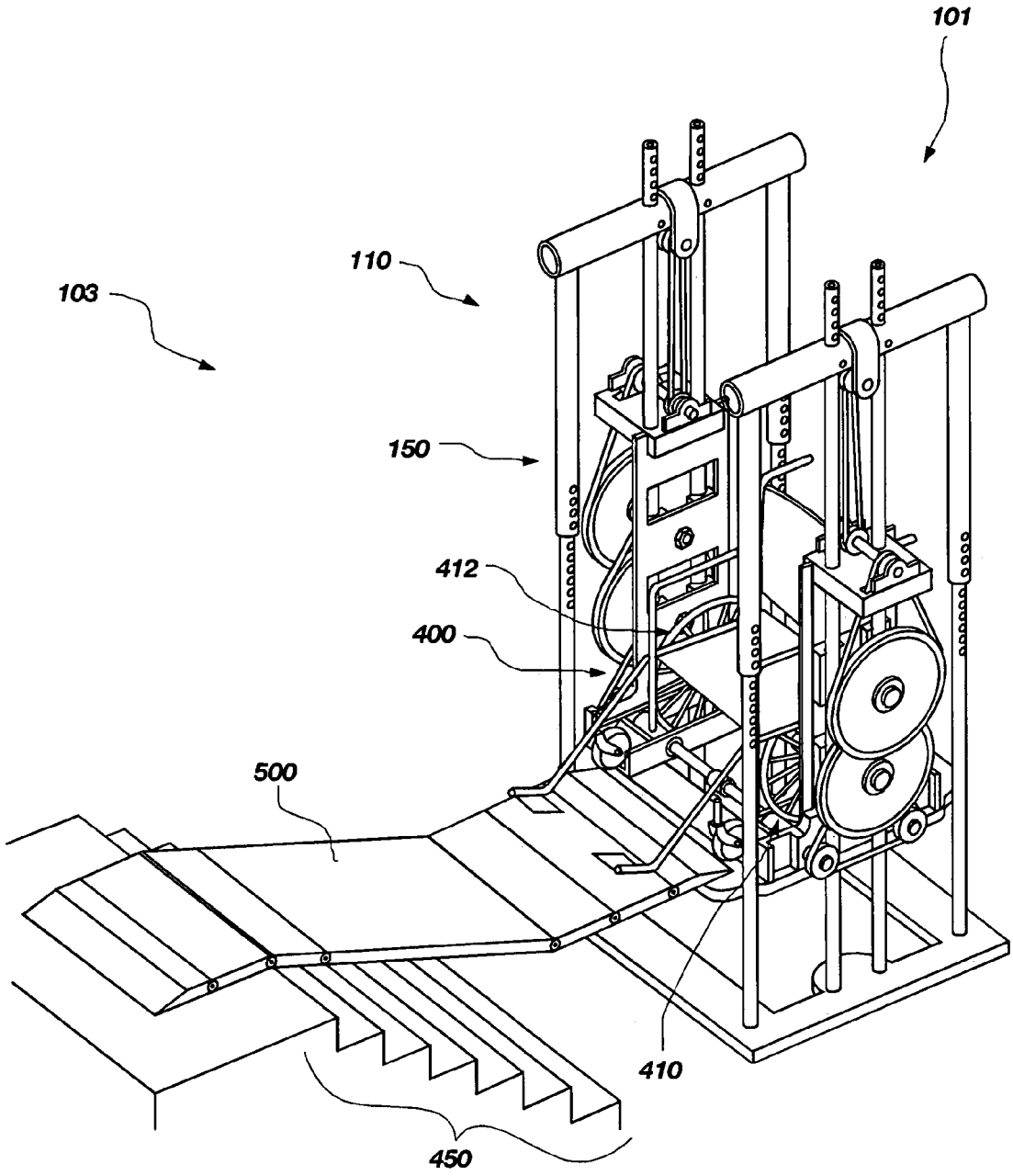
FIG. 17 shows a perspective view of the lift system shown in FIG. 17, wherein the movable platform is positioned at a selected position.
Figure 18:
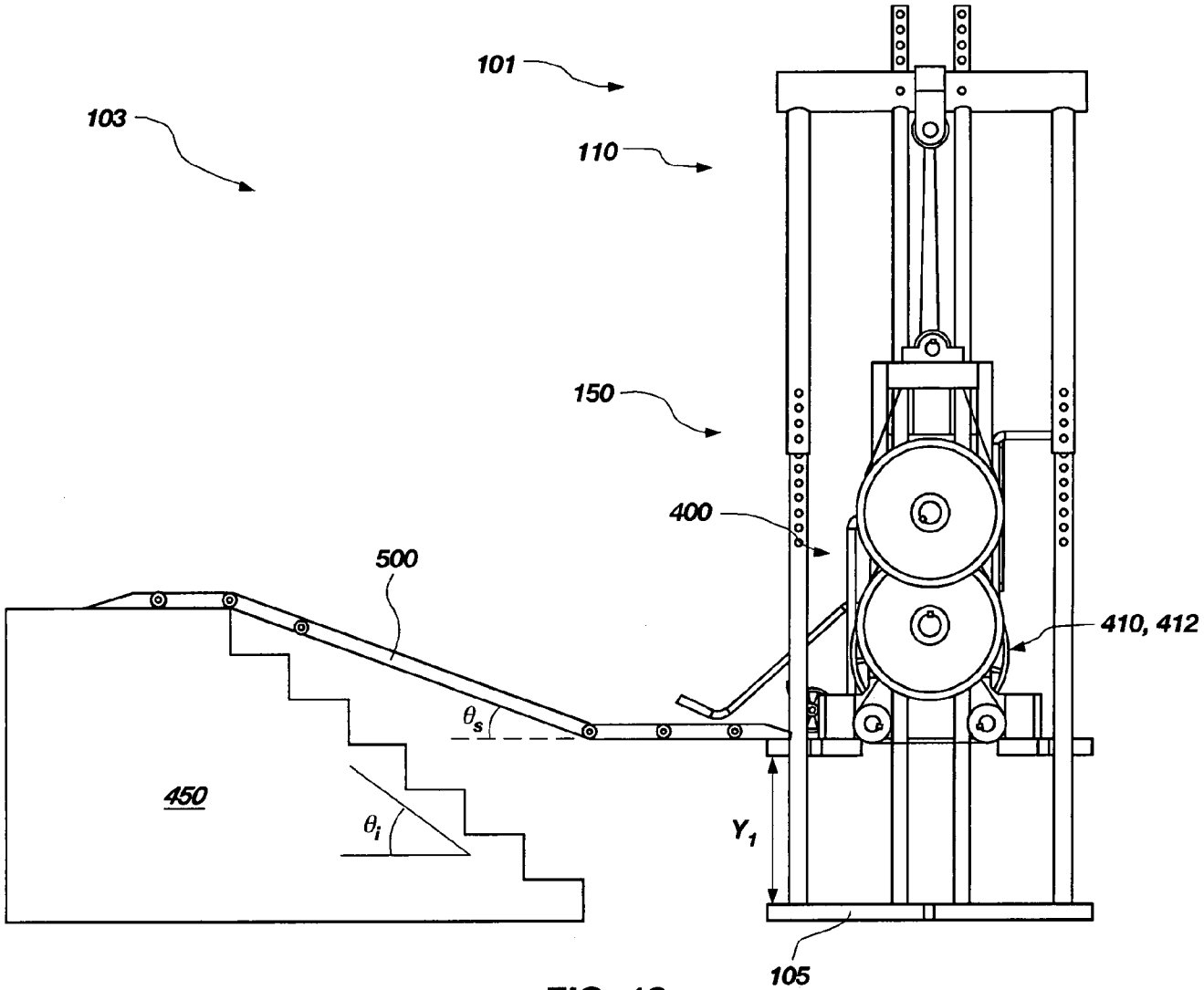
FIG. 18 shows a side view of the lift system shown in FIG. 17.
Figure 19:
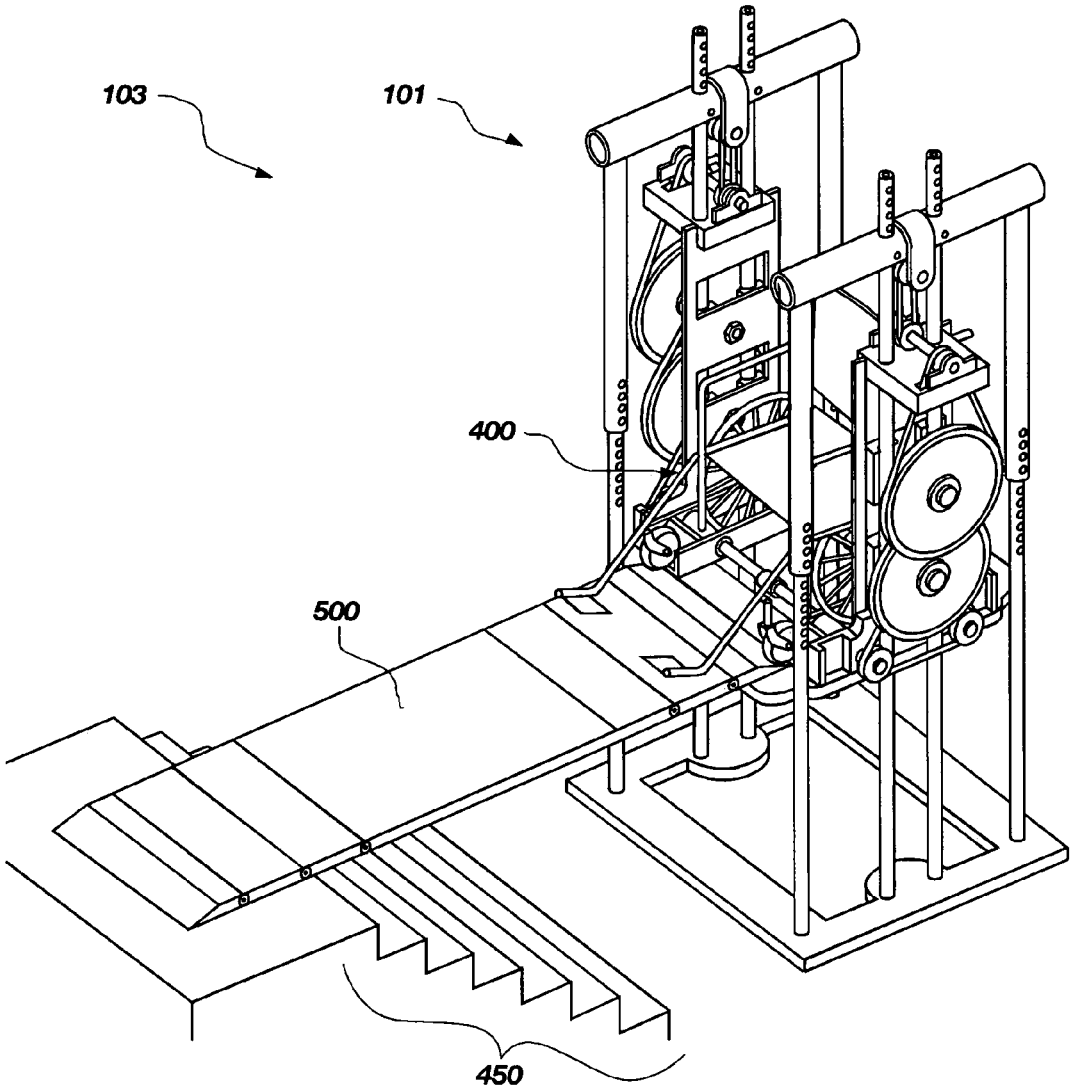
FIG. 19 shows a perspective of the lift system shown in FIG. 16, wherein the movable platform is positioned so that the ramp is substantially horizontal.
Figure 20:
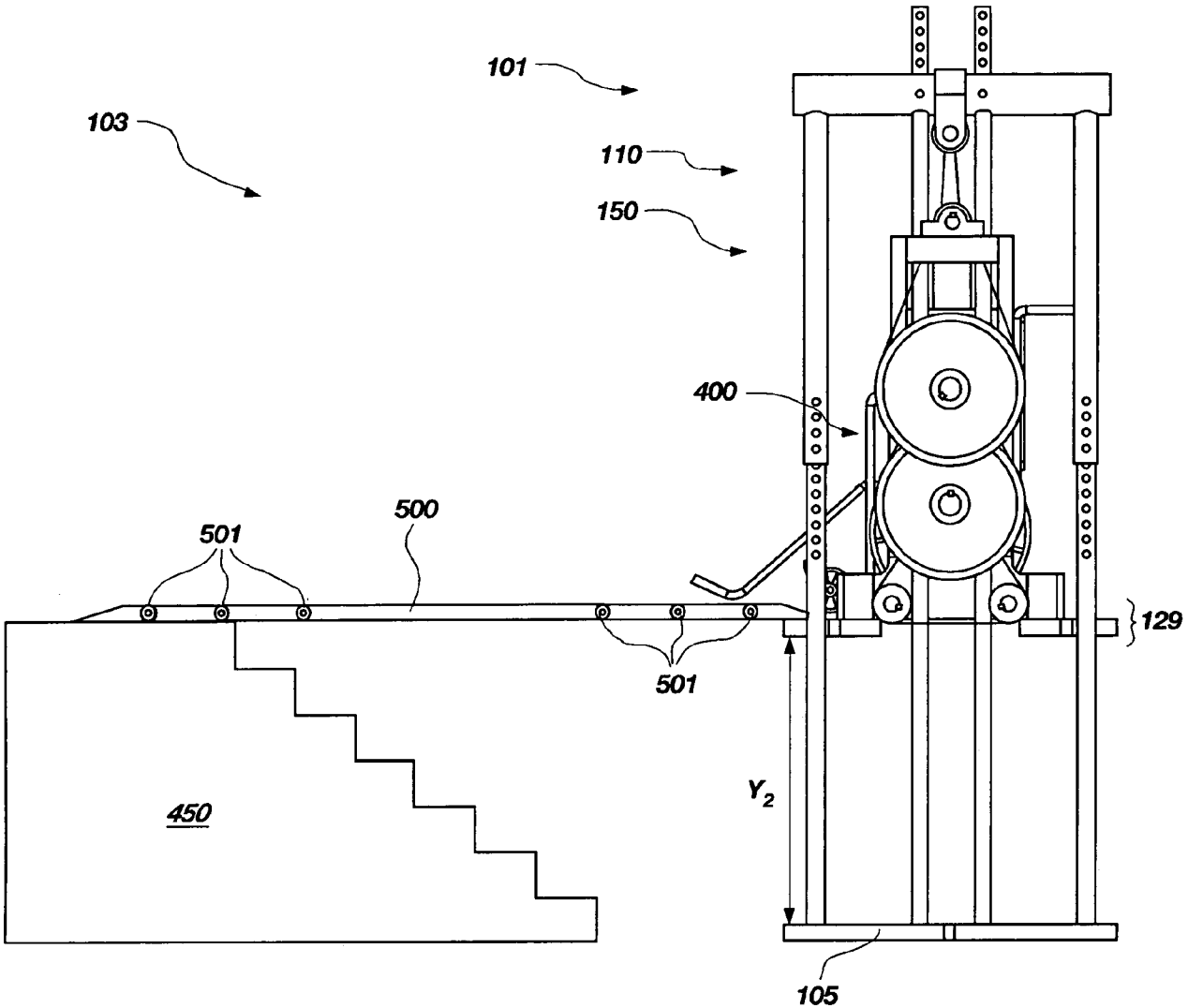
FIG. 20 shows side view of the lift system shown in FIG. 19.

In a further aspect of the present invention, as mentioned above, a lift system may include a lift apparatus and a ramp system. Such a lift system may be advantageous for allowing a wheelchair to traverse a region exhibiting varying elevation (e.g., an incline or decline). For example, FIG. 16 shows a perspective view of a lift system 103 including a lift apparatus 101 and a ramp system 500. As shown in FIG. 16, a wheelchair 400 may be positioned generally within lift apparatus 101 and may be supported by movable platform 150. As described above, at least one of wheels 410, 412 of wheelchair 400 may contact at least roller of movable platform 150. In addition, as shown in FIG. 16, ramp system 500 may include one or more hinges 501, wherein hinges 501 are structured and positioned so that ramp system 500 may at least partially conform to or follow inclined region 450, when movable platform 150 is positioned proximate to frame base 150. As discussed above, at least one of wheelchair wheels 410, 412 may be rotated to cause movable platform 150 to move relative to support frame 110. More particularly, as shown in FIGS. 17 and 18, movable platform 150 may be positioned at a selected position $Y_1$ with respect to frame base 105 of support frame 110. Such a selected position $Y_1$ may position at least a portion of ramp system 500 at a selected angle $Ø_s$, which is able to be traversed by a person operating wheelchair 400. Put another way, a person operating a wheelchair may selectively position movable platform 150 so that ramp system 500 is traversable by the wheelchair. Of course, as shown in FIG. 18, movable platform 150 may be positioned so that a magnitude of $Ø_s$ is less than a magnitude of $Ø_i$ to allow wheelchair 400 to traverse ramp system 500 and move over inclined region 450. If desired, lift apparatus 101 may be positioned so that ramp system 500 is substantially horizontal, as shown in FIGS. 19 and 20 in a perspective view and schematic side view, respectively. Thus, it may appreciated that hinges 501 may be configured for allowing relative rotation of adjacent sections of ramp system 500 within selected limits and, optionally, in selected directions. Accordingly, as shown on FIG. 20, when movable platform 150 is positioned at position $Y_2$ relative to frame base 105 of support frame 110, ramp system 500 may provide a robust, stable, relatively unyielding bridge for allowing wheelchair 400 to traverse inclined region 450. The present invention further contemplates that lift system 103 may include another ramp system (e.g., a second ramp system 500) operably coupled to movable platform 150 proximate to side region 129 of movable platform 150. Such a configuration may facilitate movement of a wheelchair generally away from inclined region 450 toward lift apparatus 101.

Thus, generally, in one embodiment, a ramp may be connected to at least one side of a lift apparatus. In one embodiment, the ramp may optionally be a solid, rigid piece of material or the ramp may be a foldable or collapsible or telescoping scaffold. As explained above, one end of the ramp may be attached to a lift apparatus so that that end raises as the movable platform assembly raises. The ramp may bridge one or more steps, so that the user may traverse the one or more steps by raising the lift to a desired height and using the ramp as a bridge to at least a portion of the raised elevation of the one or more steps. In one embodiment, the lift apparatus may be raised to a predetermined height at which the ramp is substantially horizontal.

Figure 21:
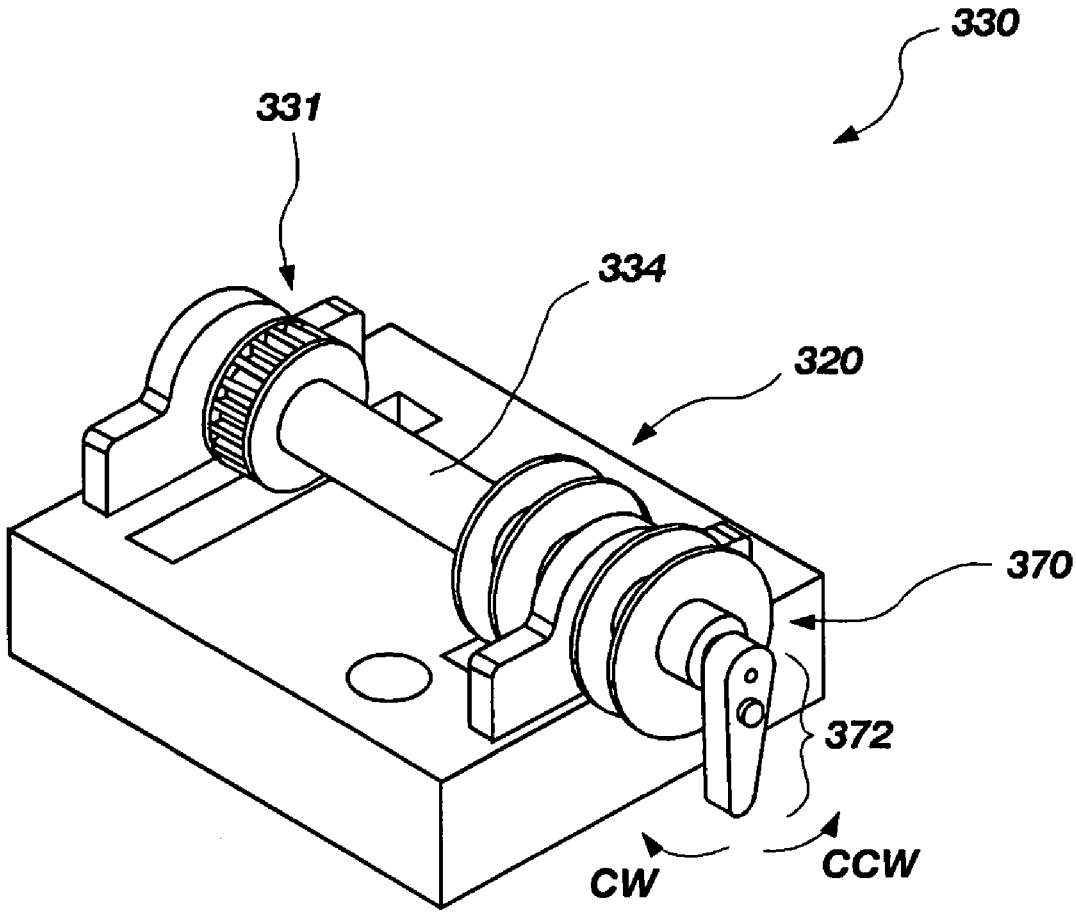
FIG. 21 shows a perspective view of a cable pulley assembly including a ratchet mechanism.

Optionally, a lift apparatus may include a limit mechanism that allows movement of the movable platform assembly in a selected direction relative to the support frame and limits movement of the movable platform in a direction opposite to the selected direction. Such a limit mechanism may include a locking feature that limits movement of the movable frame in a particular direction but allows movement in another direction. Of course, such a locking feature may be selectively switched so that the movable frame may be moved in the selected direction and limited in movement in another direction (and vice versa). For example, in one embodiment, a limit mechanism may comprise a ratchet that is operably coupled to a rotating element of a transmission coupling a moveable platform to a support frame. Particularly, FIG. 21 shows a perspective view of a cable pulley assembly 330 including a ratchet mechanism 370 operably coupled to an axle 334 of cable pulley assembly 330. Thus, ratchet mechanism 370 may be structured to allow for rotation of axle 334 and cable drive pulley 331 in a direction CW, but may limit rotation of axle 334 and cable drive pulley 331 in a direction CCW or vice versa. As shown in FIG. 21, ratchet mechanism 370 may include toggle 372, which is structured for changing the operation of the ratchet mechanism 370. More particularly, rotation of toggle 372 to a predetermined position may determine the direction of allowed rotation and the direction of limited rotation (e.g., CW allowed and CCW limited or CCW allowed and CW limited, respectively) or may disable the ratchet mechanism 370. As may be appreciated, one or more cables, one or more slender members, or any other structure suitable for operating ratchet mechanism 370 may be affixed to toggle 372 of ratchet mechanism 370 and may be accessible or otherwise operable by a wheelchair occupant positioned within a lift apparatus as discussed above.

Further, at least one ratchet mechanism 370 (or any other limit mechanism), as discussed above, may be operably coupled to any rotating element (e.g., an axle, sprocket, gear, etc.) of a transmission, without limitation. Further, such a ratchet mechanism may be coupled to at least one roller of the movable platform, if desired. Other limit mechanisms are contemplated by the present invention; for example, a limit mechanism may comprise at least one biased pin that traverses series of locking recesses or ledges as the movable platform moves in a selected direction. More than one limit mechanism may be implemented and incorporated within a lift apparatus if desired. Such a plurality of limit mechanisms may provide a desired degree of safety against unintended motion of a movable platform. Thus, at least one limit mechanism may allow for operation of a lift apparatus without danger of unintended movement of the movable platform due to the force of earthly gravity.

Further, the lift may be remotely operated by a cable or similar member connected to the ratchet mechanism 370, which extends out from the lift, for example, to attach near the top of an incline to be traversed by the wheelchair occupant. This allows a user at a higher elevation to access the lift even when the lift is in a lowered position. The cable or other remote control mechanism may be used to raise the lift to the upper position without the wheelchair occupant being positioned within the lift.

Accordingly, in use, a lift system may be positioned near one or more steps, or another area of raised elevation. A wheelchair occupant may move the wheelchair into the lift apparatus and may position the wheelchair on at least one roller of a movable platform assembly of the lift apparatus. With the wheelchair positioned on the at least one roller, the user moves at least one wheel of the wheelchair (e.g., rotates the at least one wheel as ordinarily done for traversing a substantially horizontal or inclined surface). In one embodiment, a user may apply substantially the same force to the at least one wheel as is required to traverse a substantially horizontal surface. As explained above, a transmission connects the movable platform assembly to a support frame that may include at least one substantially vertical column, in one embodiment. The transmission causes the movable platform assembly to move generally upward relative to the support frame, thereby causing the wheelchair to raise above a ground surface. As the wheelchair and the movable platform assembly raise, the ramp connected to the support also raises. A ratchet assembly may be employed for preventing the movable platform assembly from falling to the ground as the user moves the wheels to raise the lift. When the movable platform assembly reaches a selected height (e.g., when the ramp is substantially horizontal), the user may exit the lift and roll onto the ramp (for example, by pushing or pulling on the support frame to urge the wheels off of the rollers). The user then proceeds across the ramp by moving the wheels of the wheelchair. Of course, to return to the lower ground surface, the user may proceed across the ramp and enter the lift apparatus. The user deactivates the ratchet assembly to allow the movable platform to lower the wheelchair toward the lower ground surface. When the movable platform is suitably positioned, the user may then exit the lift apparatus.

One skilled in the art will appreciate that the present invention can be practiced by other than the described embodiments, which are presented for purposes of illustration and not of limitation, and the present invention is limited only by the claims which follow. Put another way, while certain embodiments and details have been included herein for purposes of illustrating the invention, it will be apparent to those skilled in the art that various changes in the methods and apparatus disclosed herein may be made without departing form the scope of the invention, which is defined in the appended claims. The words "including" and "having," as used herein including the claims, shall have the same meaning as the word "comprising."

What is claimed is:

1. A wheelchair lift apparatus comprising:

a support frame;

a platform movably coupled to the support frame, the platform comprising at least one roller;

a transmission connected to the at least one roller of the platform;

wherein rotation of the at least one roller causes the platform to move relative to the support frame; wherein the transmission is structured to cause the platform to move vertically relative to the support frame in response to a torque applied to at least one roller by rotation of at least one wheel of a wheelchair.

2. The lift apparatus of claim 1, wherein the at least one roller comprises a first roller and a second roller, wherein the first roller and the second roller are structured to support at least one wheel of a wheelchair and are intended to rotate in response to rotation of the at least one wheel of the wheelchair.

3. The lift apparatus of claim 1, wherein the support frame comprises at least one column extending from a frame base of the support frame.

4. The lift apparatus of claim 1, wherein the support frame comprises a first support column and a second support column extending a frame base of the support frame and is positioned to accommodate a wheelchair positioned between the first support column and the second support column.

5. The lift apparatus of claim 1, wherein a torque generated by about 12 pounds of force or less applied tangentially to the at least one roller causes the platform to move relative to the support frame.

6. The lift apparatus of claim 1, further comprising a ratchet assembly configured to limit movement of the platform in a first direction and allow movement of the platform in a selected direction.

7. The lift apparatus of claim 6, wherein the ratchet assembly comprises a release mechanism that allows the movable platform to move in the first direction.

8. The lift apparatus of claim 1, wherein the transmission comprises at least one of the following: a chain, a sprocket, a gear, a pulley, a pinion pulley, a belt, a rope, and an axle.

9. The lift apparatus of claim 1, wherein the transmission is structured to generate a mechanical advantage of at least about 50 relative to a force applied tangentially to the at least one roller.

10. The lift apparatus of claim 1, wherein the transmission comprises a first sub-assembly configured for causing the platform assembly to move relative to the first support column and a second sub-assembly configured for causing the platform assembly to move relative to the second support column.

11. The lift apparatus of claim 10, wherein the first sub-assembly and the second sub-assembly are substantially identical.

12. The lift apparatus of claim 10, wherein:

the at least one roller comprises four rollers, two of the four rollers coupled to a first drive axle and the other two of the four rollers coupled to a second drive axle;

the first sub-assembly and the second sub-assembly each comprise:

two drive pinion pulleys operably coupled, respectively, to the first drive axle and the second drive axle;

a lower drive belt operably coupled to the two drive pinion pulleys and to a first intermediate pinion pulley operably coupled to an intermediate axle;

a second intermediate pinion pulley operably coupled to the intermediate axle;

an upper drive belt operably coupled to the second intermediate pinion pulley and to a sprocket pinion pulley affixed to a sprocket axle;

a sprocket assembly affixed to the sprocket axle, the sprocket assembly comprising:

two drive sprockets; and an idler sprocket.

13. The lift apparatus of claim 10, wherein:

the at least one roller comprises four rollers, two of the four rollers coupled to a first drive axle and the other two of the four rollers coupled to a second drive axle;

the first sub-assembly and the second sub-assembly each comprise:

two drive pinion pulleys operably coupled, respectively, to the first drive axle and to the second drive axle;

a lower belt operably coupled to the two drive pulleys and to a first intermediate pinion pulley affixed to a first intermediate axle;

a second intermediate pinion pulley operably coupled to the first intermediate axle;

a third intermediate pinion pulley operably coupled to a second intermediate axle;

a first intermediate belt operably coupled to the second intermediate pinion pulley and to the third intermediate pinion pulley;

a fourth intermediate pinion pulley operably coupled to a second intermediate axle;

an second intermediate belt operably coupled to the fourth intermediate pinion pulley and to a cable drive pinion pulley;

a cable defining a length between the support frame and the platform, wherein the length between the support frame and the platform changes in response to rotation of the cable drive pinion pulley.

14. A lift comprising:

a support frame;

a platform movably coupled to the support frame; a transmission connected to the at least one roller of the platform;

means for moving the platform and a wheelchair supported by the platform by rotation of at least one wheel of the wheelchair wherein the transmission is structured to cause the platform to move vertically relative to the support frame in response to a torque applied to at least one roller by rotation of at least one wheel of a wheelchair.

15. The lift of claim 14, wherein the means for moving the platform and the wheelchair supported by the platform comprises a transmission.

16. The lift of claim 14, wherein the means for moving the platform and the wheelchair supported by the platform comprises at least one of the following: a chain, a sprocket, a gear, a pulley, a pinion pulley, a belt, a rope, and an axle.

* * * * *

UNITED STATES PATENT AND TRADEMARK OFFICE

CERTIFICATE OF CORRECTION

PATENT NO. : 7,325,654 B2
APPLICATION NO. : 11/288545
DATED : February 5, 2008
INVENTOR(S) : Joseph Stanislao It is certified that error appears in the above-identified patent and that said Letters Patent is hereby corrected as shown below:

In the title on the first page (item 54), the term "List" should be replaced with --Lift--.

Column 1, line 1, the term "List" should be replaced with --Lift--.

Signed and Sealed this

Seventeenth Day of June, 2008

JON W. DUDAS
*Director of the United States Patent and Trademark Office*